US007387707B2

(12) United States Patent
Tamagawa

(10) Patent No.: US 7,387,707 B2
(45) Date of Patent: Jun. 17, 2008

(54) SUPPORT FOR IMAGE-RECORDING MATERIAL, PROCESS FOR MANUFACTURING THEREOF, AND IMAGE-RECORDING MATERIAL

(75) Inventor: Shigehisa Tamagawa, Shizuoka (JP)

(73) Assignee: FUJIFILM Corporation, Tokyo (JP)

( * ) Notice: Subject to any disclaimer, the term of this patent is extended or adjusted under 35 U.S.C. 154(b) by 323 days.

(21) Appl. No.: 10/769,785

(22) Filed: Feb. 3, 2004

(65) Prior Publication Data

US 2004/0157072 A1 Aug. 12, 2004

(30) Foreign Application Priority Data

Feb. 7, 2003 (JP) ..... 2003-031658

(51) Int. Cl.
*D21H 19/72* (2006.01)
*D21H 19/22* (2006.01)

(52) U.S. Cl. ..... 162/206; 162/135; 162/136; 162/137; 162/169; 162/205; 430/538

(58) Field of Classification Search ..... 162/123, 162/127, 130, 131, 134–136, 168.7, 204–207, 162/358.1, 358.3, 358.5, 359.1, 375, 379, 162/168.1, 169; 430/523, 531, 538, 930; 100/37, 38

See application file for complete search history.

(56) References Cited

U.S. PATENT DOCUMENTS 3,354,035 A * 11/1967 Gottwald et al. ..... 162/206
4,935,097 A * 6/1990 Tashiro et al. ..... 162/135
5,092,962 A * 3/1992 Koski ..... 162/206
5,706,587 A 1/1998 Lehtinen et al.
6,107,014 A * 8/2000 Dagan et al. ..... 430/496
6,800,359 B2 * 10/2004 Nakamura et al. ..... 428/206

FOREIGN PATENT DOCUMENTS

| | | | |
|---|---|---|---|
| JP | 1-292354 | A | 11/1989 |
| JP | 5-232627 | A | 9/1993 |
| JP | 7-028270 | A | 1/1995 |
| JP | 2000-010330 | A | 1/2000 |
| JP | 2002-088690 | A | 3/2002 |
| JP | 2003-005419 | | 1/2003 |
| WO | WO 97/19223 | A | 5/1997 |

OTHER PUBLICATIONS

JPO machine translation of JP 05-232627.*
Japanese Office Action dated Jun. 20, 2006.
Chinese Office Action dated Jan. 5, 2007 with English language translation.

* cited by examiner

*Primary Examiner*—Eric Hug
(74) *Attorney, Agent, or Firm*—Sughrue Mion, PLLC

(57) ABSTRACT

An object is to provide a support for image-recording material excellent in dimension stability and smoothness, a manufacturing process of the support, and an image-recording material which employs such support and which can obtain a high quality image. Accordingly, provided is a support for an image-recording material which comprises at least a sheet of raw paper wherein a pressure drying treatment is performed at a temperature of from 100° C. to 200° C. on the raw paper sheet having a water content of from 30% to 70%, while applying pressure to a surface of the raw paper sheet on which an image-recording layer is to be formed, and a calender treatment is carried out afterwards using at least one calender.

10 Claims, 3 Drawing Sheets

SUPPORT FOR IMAGE-RECORDING MATERIAL, PROCESS FOR MANUFACTURING THEREOF, AND IMAGE-RECORDING MATERIAL

BACKGROUND OF THE INVENTION

1. Field of the Invention

The present invention relates to supports for an image-recording material which have better density, elasticity modulus, tensile strength, strength, and the like; which are excellent in dimension stability and smoothness; and with which curling is less likely to occur, compared with conventional supports. The present invention also relates to processes for manufacturing such supports for an image-recording material and to image-recording materials using such supports thereby being capable of forming high quality images.

2. Description of the Related Art

Conventionally, in a process of fast and efficient papermaking, a sheet of paper is dried as it passes through a number of cylindrical driers while being tensioned in a vertical direction (the direction of papermaking) and contracting freely in a horizontal direction. Accordingly, when such a sheet of paper is subjected to a change of humidity, it tends to contract or expand largely in the horizontal direction. Therefore, when the sheet of paper is used as a support and information is recorded for example in a form of a photograph, curling occurs and provides a disadvantage of not being able to obtain a high quality image.

To solve this issue, transfer paper for electrophotography proposed in Japanese Patent Application Laid-Open (JP-A) No. 01-292354 (Japanese Patent (JP-B) No. 2739160) is manufactured using a so-called Yankee paper machine which does not tension in the vertical direction during the drying process and can restrict the drying contraction in both vertical and horizontal directions so that even if the transfer sheet is subjected to a humidity change after it is dried, the rate of contraction is small, its smoothness is excellent, and a degree of curling is small.

However, when a sheet of paper is manufactured using a Yankee paper machine as in JP-A No. 01-292354, the freeness of pulp is generally limited to a range of from 400 ml to 600 ml Canadian Standard Freeness (C.S.F.) and many other papermaking conditions such as papermaking speed are limited, resulting in very strict limitation on manufacturing.

On the other hand, a treatment in which a sheet of paper is dried while being pressurized (hereinafter may be referred to as pressure drying treatment or press dry treatment) is expected to provide higher strength, elasticity modulus, density and the like, and such process is currently under development (T. Kadoya et al., *Seishi Kagaku* [Science of papermaking] (Tokyo: Chugai Sangyo Chosakai, 1982), pp. 174-177). In addition, JP-A Nos. 2000-500536 and 07-91829 (JP-B No. 3041754) propose web pressure drying apparatuses which perform thermal drying of a fiber web with a press dry treatment and provide less limitations when used in a manufacturing line.

However, Seishi Kagaku does not disclose nor suggest specific conditions or the like for a press dry treatment. Moreover, JP-A Nos. 2000-500536 and 07-91829 only disclose press dry apparatuses and they do not disclose nor suggest a relationship between a press dry treatment and a support for an image-recording material. Therefore it is difficult to predict that a press dry treatment is applicable to a support for an image-recording material and that a high quality image can be formed.

OBJECTS AND ADVANTAGES

An object of the present invention is to provide supports for an image-recording material which have better density, elasticity modulus, tensile strength, strength, and the like; which are excellent in dimension stability and smoothness; and with which curling is less likely to occur, compared with conventional supports. Another object of the present invention is to provide processes for manufacturing such supports for an image-recording material and image-recording materials using such supports which are capable of forming high quality images.

SUMMARY OF THE INVENTION

A support for an image-recording material according to the present invention comprises at least a sheet of raw paper wherein a pressure drying treatment is performed at a temperature of from 100° C. to 200° C. on the raw paper sheet having a water content of from 30% to 70%, while applying pressure to a surface of the raw paper sheet on which an image-recording layer is to be formed, and a calender treatment is carried out afterwards using at least one calender. With regards to the support for an image-recording material of the present invention, by performing a pressure drying treatment on a sheet of raw paper having a water content of from 30% to 70%, in which the sheet is dried while being pressurized, it is possible to provide a support for an image-recording material which has improved density, elasticity modulus, tensile strength, strength, and the like; which is excellent in dimension stability and smoothness; and with which curling is less likely to occur.

A process for manufacturing a support for an image-recording material according to the present invention is a process for manufacturing a support for an image-recording material which comprises at least a sheet of raw paper, the process comprising pressure drying a sheet of raw paper having a water content of from 30% to 70% at a temperature of from 100° C. to 200° C. while applying pressure to a surface of the raw paper sheet on which an image-recording layer is to be formed, and calendering the pressure dried sheet of raw paper with at least one calender. According to the process for manufacturing a support for an image-recording material of the present invention, a high quality support for an image-recording material can be manufactured efficiently.

An image-recording material of the present invention comprises a support and an image-recording layer on the support wherein the support is a support for an image-recording material of the present invention. It can be used as, for example, an electrophotographic image-receiving material, thermal color development recording material, inkjet recording material, sublimation transfer image-receiving material, silver halide photographic photosensitive material, and thermal transfer image-receiving material, and can provide high quality images thereon.

DESCRIPTION OF THE PREFERRED EMBODIMENTS

Support for Image-Recording Material

A support for an image-recording material according to the present invention comprises at least a sheet of raw paper wherein a pressure drying treatment (press dry treatment) is performed at a temperature of from 100° C. to 200° C. on the raw paper sheet having a water content of from 30% to 70%, while applying pressure to a surface of the raw paper sheet on which an image-recording layer is to be formed, and a calender treatment is carried out afterwards using at least one calender.

—Pressure Drying Treatment (Press Dry Treatment)—

The press dry treatment is not particularly limited and may suitably be selected according to the purpose, provided that it can heat and dry pulp while pressing it to soften paper fibers and allow the fibers to come close to each other. For example, pulp is dehydrated using a papermaking machine and then its water content before press dry treatment is adjusted to 30% to 70%, preferably from 45% to 60%, using a wet press apparatus or the like, thereby forming a sheet of raw paper. Then, a press dry treatment is performed on an image-recording side of the sheet at a drying temperature of from 100° C. to 200° C., preferably from 110° C. to 180° C.

When the drying temperature is lower than 100° C., a sufficient amount of water does not evaporate and bonding among fibers becomes weak, which sometimes results in unfavorable paper strength. When it is higher than 200° C., size and planarity may become insufficient due to the relationship with additives.

The pressure of the press dry treatment is preferably from 0.05 MPa to 1.5 MPa, and more preferably from 0.1 MPa to 1.0 MPa.

Figure 1:
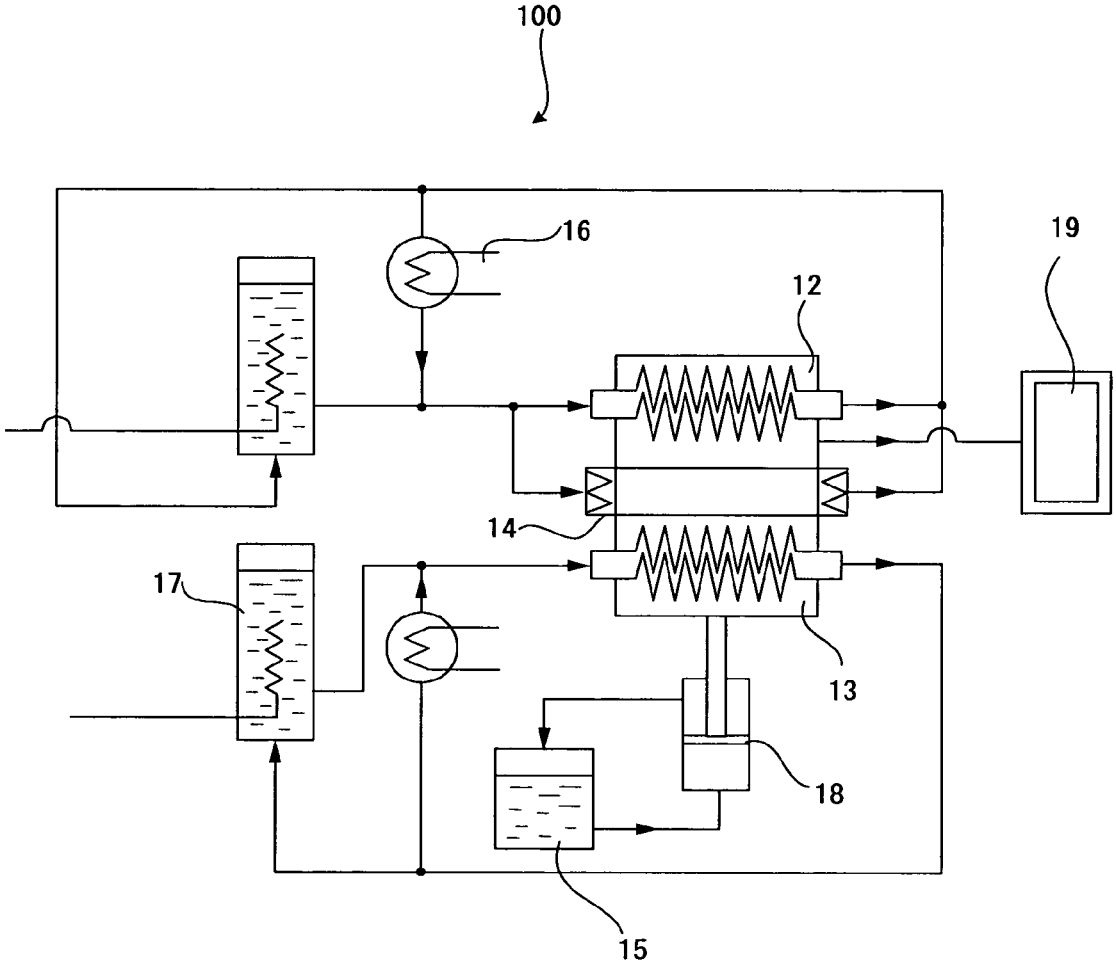
FIG. 1 is a schematic view showing an example of a press dry treatment apparatus according to the present invention.

The apparatus with which the press dry treatment is performed is not particularly limited and may suitably be selected according to the purpose. For example, a press dry apparatus 100 based on Condebelt drying technique as shown in FIG. 1 is preferable as an apparatus which is not incorporated in a production line and oriented towards laboratory use.

The press dry apparatus 100 has an upper plate 12, a lower plate 13, a jacket 14 provided between the upper plate 12 and the lower plate 13, and one or more other members if necessary.

Drying with the press dry apparatus 100 is performed by placing a sheet of wet paper (not shown) which has been prepared by dehydrating pulp with a papermaking machine and a wet press apparatus or the like in a jacket 14 which is impermeable to air; and thermal drying and pressuring the sheet with the upper plate 12 and lower plate 13 the temperatures of which are each controlled by electrically heated oil 17. During pressure drying, water vapor and the like which are generated at the wet paper are removed by a vacuum tank 19. Pressuring is performed by applying pressure to the lower plate 13 with a pressing unit 18 using hydraulic oil 15. Further, during pressure drying, cooling water 16 is configured to flow through the apparatus.

For example, STATIC CONDEBELT static press dry equipment (manufactured by VALMET) may be used as one of such press dry apparatuses.

Figure 2:
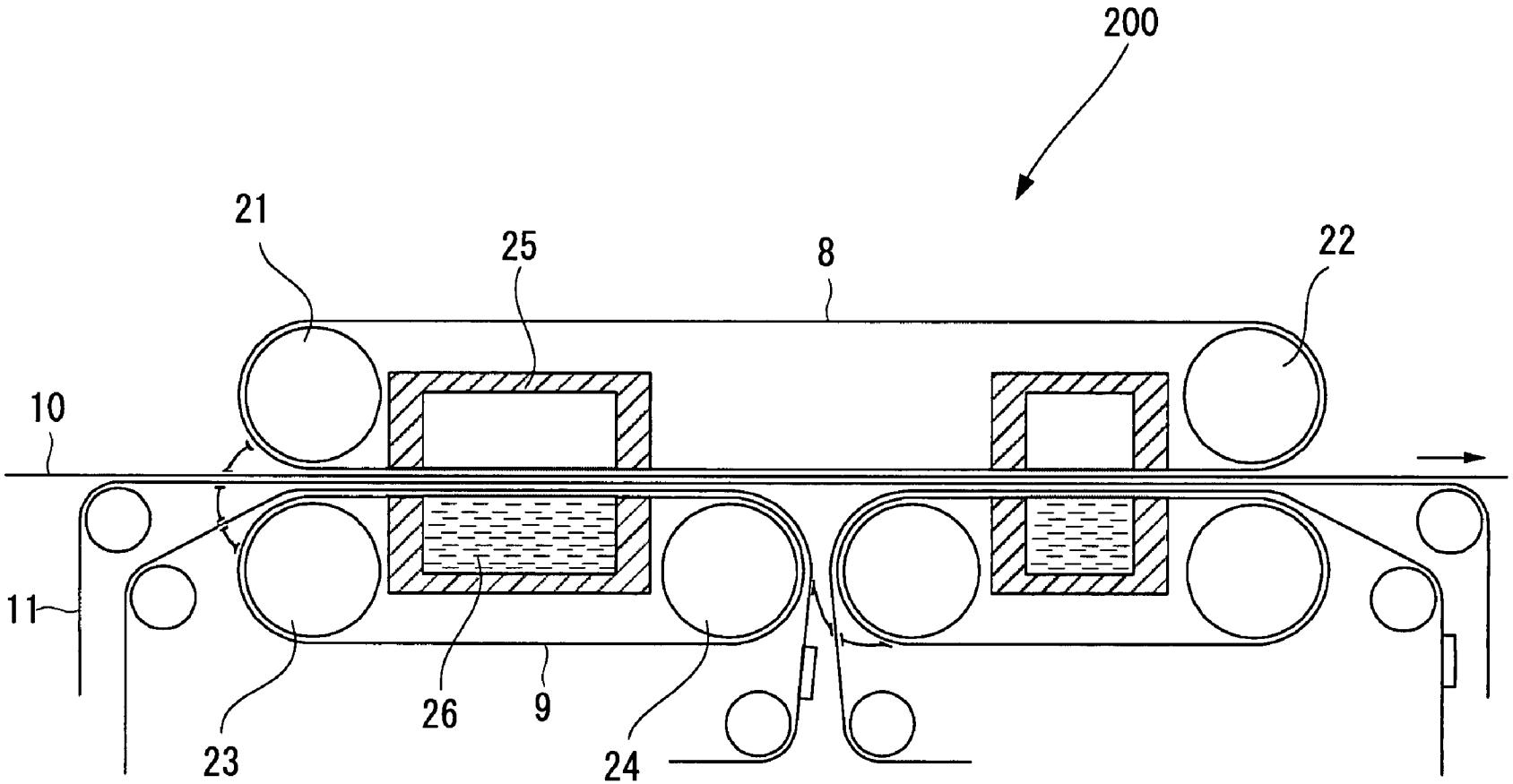
FIG. 2 is a schematic view showing an example of an apparatus in a production line where the press dry treatment of the present invention is performed.

On the other hand, when the press dry treatment is to be incorporated into a production line so that it can be performed continuously, a press dry apparatus 200 as shown in FIG. 2 is preferable.

Referring to FIG. 2, the press dry apparatus 200 comprises a first endless belt 8 and a second endless belt 9 which are impermeable to air and conduct heat well, a first set of turning rollers 21 and 22 around which the first endless belt 8 is arranged to turn, and a second set of turning rollers 23 and 24 around which the second endless belt 9 is arranged to turn.

The first and second endless belts 8 and 9 are arranged in such a way that they run part of the way parallel with each other so that they form a drying zone between themselves.

A heating chamber 25 heats the first endless belt 8, and a cooling chamber 26 cools the second endless belt 9.

Then, dehydrated wet paper 10 and at least one fabric 11 which forms an endless loop are introduced between the first and second endless belts 8, 9 in such a way that the dehydrated wet paper 10 is in contact with the heated first endless belt 8 and the fabric 11 is positioned between the dehydrated wet paper 10 and both of the cooled second endless belt 9 and guide rollers and accordingly the wet paper 10 is pressure dried.

The details of the press dry apparatus 200 are described in, for example, JP-A No. 2000-500536.

According to this press dry apparatus, it is possible to achieve a good press dry result more efficiently than with conventional ones.

By the press dry treatment described above, the sheet of raw paper has better density, elasticity modulus, tensile strength, strength, and the like so as to provide a support for an image-recording material which is excellent in dimension stability and smoothness and with which curling is less likely to occur. Accordingly, by using the support in an image-recording material, it is possible to provide high quality images.

—Raw Paper—

The raw paper may be a high quality paper, for example, the paper described in *Shashin kogaku no kiso—ginen shashin hen* [Basic Photography Engineering—Silver Halide Photography], CORONA PUBLISHING CO., LTD. (1979) pp. 223-240, edited by the Institute of Photography of Japan.

In the raw paper, it is preferred to use pulp fibers having a fiber length distribution as disclosed, for example, in Japanese Patent Application Laid-Open (JP-A) No. 58-68037 (for example, the sum of 24-mesh screen residue and 42-mesh screen residue is 20% by mass to 45% by mass, and 24-mesh screen residue is 5% by mass or less) in order to give the desired center line average roughness to the surface. Moreover, the center line average roughness can be adjusted by heating and giving a pressure to a surface of the raw paper, with a machine calender, super calender, or the like.

The raw paper is not particularly limited, and can suitably be selected from various kinds of materials according to the purpose, provided that they are well known materials for supports for an image-recording material. Examples of the materials of the raw paper include natural pulp selected from needle-leaf trees and broadleaf trees, synthetic pulp made from plastics materials such as polyethylene, polypropylene, or the like, a mixture of the natural pulp and the synthetic pulp, and the like.

Regarding pulps used as materials for the raw paper, from the viewpoint of good balance between surface flatness and smoothness of the raw paper, rigidity and dimensional stability (curl), broadleaf tree bleached kraft pulp (LBKP) is preferred. Needle-leaf bleached kraft pulp (NBKP), broadleaf tree sulfite pulp (LBSP), or the like can also be used.

It is suitable that the pulp fibers consist mostly of broadleaf tree pulps whose fiber length is short by nature. Preferably, the mass average fiber length of the pulp fibers is from 0.45 mm to 0.70 mm.

A beater or a refiner, or the like, can be used for beating the pulp.

When paper is made by press dry treatment, the Canadian Standard Freeness (CSF) of the pulp is preferably from 200 ml CSF to 400 ml CSF, and more preferably from 250 ml CSF to 350 ml CSF, to control contraction of paper during the treatment.

Various additives, for example, fillers, dry paper reinforcers, sizing agents, wet paper reinforcers, fixing agents, pH regulators or other agents, or the like may be added, if necessary, to the pulp slurry (hereafter, may be referred to as pulp paper material) which is obtained after beating the pulp.

Examples of the fillers include calcium carbonate, clay, kaolin, white clay, talc, titanium oxide, diatomaceous earth, barium sulfate, aluminum hydroxide, magnesium hydroxide, and the like.

Examples of the dry paper reinforcers include cationic starch, cationic polyacrylamide, anionic polyacrylamide, amphoteric polyacrylamide, carboxy-modified polyvinyl alcohol, and the like.

Examples of the sizing agents include rosin derivatives such as aliphatic salts, rosin, maleic rosin or the like; paraffin wax, alkyl ketene dimer, alkenyl succinic anhydride (ASA), epoxy aliphatic amide, and the like. Of these, alkyl ketene dimmer and epoxy aliphatic amide are particularly preferred.

Examples of the wet paper reinforcers include polyamine polyamide epichlorohydrin, melamine resin, urea resin, epoxy polyamide resin, and the like.

Examples of the fixing agents include polyfunctional metal salts such as aluminum sulfate, aluminum chloride, or the like; cationic polymers such as cationic starch, or the like.

Examples of the pH regulators include caustic soda, sodium carbonate, and the like.

Examples of other agents include defoaming agents, dyes, slime control agents, fluorescent whitening agents, and the like.

Moreover, softeners can also be added if necessary. For the softeners, ones which are disclosed on pp. 554-555 of *Paper and Paper Treatment Manual* (Shiyaku Time Co., Ltd.) (1980) and the like can be used, for example.

Treatment liquids used for sizing a surface is not particularly limited, and can suitably be selected according to the purpose. They may contain, for example, water-soluble macromolecules, sizing agents, waterproof materials, pigments, pH regulators, dyes, fluorescent whitening agents, and the like.

Examples of the water-soluble macromolecules include cationic starch, polyvinyl alcohol, carboxy-modified polyvinyl alcohol, carboxymethylcellulose, hydroxyethylcellulose, cellulose sulfite, gelatin, casein, sodium polyacrylate, styrene-maleic anhydride copolymer sodium salt, sodium polystyrene sulfonate, and the like.

Examples of the waterproof materials include latex emulsions such as styrene-butadiene copolymer, ethylene-vinyl acetate copolymer, polyethylene, vinylidene chloride copolymer or the like; polyamide polyamine epichlorohydrin, and the like.

Examples of the pigments include calcium carbonate, clay, kaolin, talc, barium sulfate, titanium oxide, and the like.

The raw paper is made by dehydrating the pulp using a papermaking machine or the like, then forming wet paper by using a wet press apparatus or the like upon the dehydrated pulp, and then performing a press dry treatment on the wet paper.

The water content of the raw paper before press dry treatment is preferably from 30% to 70%, and more preferably from 45% to 60%. When the water content is less than 30%, paper strength may not be sufficient, and when it is more than 70%, the raw paper may be torn after the press dry treatment.

In this specification including the claims, "wet paper" means "raw paper before press dry treatment."

The water content of the raw paper can be measured according to Japanese Industrial Standards (JIS) P8127.

The press-dry-treated raw paper can be further treated, for example, to prepare on the raw paper a face on which an image-recording layer is formed (which may be referred to as "surface" hereinafter) by performing a high-temperature soft calender treatment.

For example, a surface having a glossiness of 25% or more may be formed by the soft calender treatment in which a hot metal surface of a roller is applied to the surface of the raw paper.

The surface temperature of the metal roller is preferably 110° C. or more, more preferably 150° C. or more, and still more preferably 250° C. or more. The upper limit may for example be around 300° C.

In the related art, even if soft calender treatment is given to the raw paper surface before applying a coating solution, it appears that the temperature is no more than about 90° C. In calender treatment using a metal surface at this temperature (less than around 90° C.), the glossiness of the raw paper surface would for example be around 12%.

The aforesaid metal surface may for example be the surface of a metal roller. Calender treatment using the metal surface may be performed by using a pair of calender rollers, at least one of which is a metal roller.

These calender rollers may for example be soft calender rollers comprising a combination of a metal roller and a synthetic resin roller, or machine calender rollers comprising a pair of metal rollers. Of these, soft calender rollers are preferable, in particular a shoe calender having long nip which comprises a metal roller and a shoe roller via a synthetic resin belt having a nip width of as large as 50 mm to 270 mm, which is preferred from a viewpoint of increasing the contact area between the raw paper and the rollers.

Calender treatment may include the aforesaid calender treatments used alone or in combination.

Regardless of the type of the calender apparatus, calender treatment is preferably performed by passing the raw paper through the apparatus where a metal roller is in contact with an image-recording surface, and it is more preferable when the metal roller has a surface temperature of 110° C. or higher. It is still further preferable to perform a calender treatment in which the raw paper is passed through and a metal roller of 150° C. or higher is in contact therewith. If the calender treatment in which the raw paper is passed through so that a metal roller is in contact with an image-recording surface is not performed, the density of the raw paper does not increase and its smoothness does not sufficiently improve, which makes it difficult to form high-quality images comparable to silver halide photographs.

A nip pressure when the raw paper is subjected to soft calender treatment is for example preferably 100 kN/m$^2$ or more, and more preferably 100 kN/m$^2$ to 600 kN/m$^2$.

As for the above-mentioned raw paper, to improve the rigidity and dimensional stability (curl), it is preferred that the ratio (Ea/Eb) of the longitudinal Young's modulus (Ea) and the lateral Young's modulus (Eb) is within the range of 1.5 to 2.0. If the ratio (Ea/Eb) is less than 1.5 or more than 2.0, the rigidity and curl of the image-recording material tend to deteriorate, and may interfere with paper when transported.

It has been found that, in general, the "stiffness" of the paper differs based on differences in the way the paper is beaten, and the elasticity (modulus) of paper from paper-making after beating can be used as an important indication of the "stiffness" of the paper. The elastic modulus of the paper can be calculated from the following equation by using the relation of the density and the dynamic modulus which shows the physical properties of a viscoelastic object, and by measuring the velocity of sound propagation in the paper using an ultrasonic oscillator.

$$E=\rho c^2(1-n^2)$$

where "E" represents dynamic modulus; "ρ" represents density; "c" represents the velocity of sound in paper; and "n" represents Poisson's ratio.

As n=0.2 or so in a case of ordinary paper, there is not much difference in the calculation, even if the calculation is performed by the following equation:

$$E=\rho c^2$$

Accordingly, if the density of the paper and acoustic velocity can be measured, the elastic modulus can easily be calculated. In the above equation, when measuring acoustic velocity, various instruments known in the art may be used, such as a Sonic Tester SST-110 (Nomura Shoji Co., Ltd.) or the like.

The raw paper of a support for an image-recording material, after being treated with at least one of press drying and calendering, preferably has a density of 0.9 g/cm$^3$ or more, more preferably 0.95 g/cm$^3$ or more, and still more preferably from 1.00 g/cm$^3$ to 1.10 g/cm$^3$. When the density is less than 0.9 g/cm$^3$, the smoothness may not improve sufficiently.

The thickness of the raw paper is not particularly limited, and can suitably be selected according to the purpose, and it is preferably 30 μm to 500 μm, and more preferably 50 μm to 300 μm, and still more preferably 100 μm to 250 μm. The basis weight of the raw paper is not particularly limited, and can suitably be selected according to the purpose, and for example, it is preferably from 50 g/m$^2$ to 250 g/m$^2$, and more preferably from 100 g/m$^2$ to 200 g/m$^2$.

—Polymer Layer—

The support for an image-recording material preferably has on at least one face of the raw paper, more preferably on each face, a polymer layer coating from the viewpoint of smoothness and the ability to improve image quality.

The polymer layer is not particularly limited and may be suitably selected according to the purpose, but a polyolefin resin may for example be used therefor.

The polyolefin resin layer is formed of a polyolefin resin such as a homopolymer of an α-olefin including polyethylene, polypropylene or the like, a mixture thereof, or the like. As long as extrusion coating is possible, there is no particular limitation on the molecular weight of the polyolefin resin, and it may be selected according to the purpose. However, a polyolefin resin having a molecular weight of from 20,000 to 200,000 is normally used.

The polyethylene resin is not particularly limited, and may be selected according to the purpose. Examples thereof include high density polyethylene (HDPE), low density polyethylene (LDPE), linear low density polyethylene (L-LDPE) and the like.

For example, from the view point that cut surfaces are uniform and fine when cut into a predetermined size with a cutter or the like, it is preferable to use a polyethylene resin mixture of from 40 to 75 parts by mass of a high density polyethylene having a melt index of from 5 g/10-min to 30 g/10-min, more preferably from 10 g/10-min to 20 g/10-min, and a density of 0.945 g/cm$^3$ or higher; and from 25 to 60 parts by mass of a low density polyethylene having a melt index of from 1 g/10-min to 15 g/10-min, more preferably from 2 g/10-min to 10 g/10-min, and a density of from 0.930 g/cm$^3$ or lower. These resins may be used alone, or in combination of two or more.

The mixing ratio of the aforesaid high density polyethylene and the low density polyethylene (HDPE/LDPE) is preferably 40 to 75/60 to 25, and more preferably 50 to 70/50 to 30 in mass ratio. A support having a polyolefin resin layer formed by coating a polyethylene mixture containing 75 parts by mass or more of the high density polyethylene and less than 25 parts by mass of the low density polyethylene may not exhibit sufficient cutting properties (uniform cut surface) in the cutting step. On the other hand, a support having a polyolefin resin layer formed by coating a polyethylene mixture containing less than 40 parts by mass of the high density polyethylene and 60 parts by mass or more of the low density polyethylene may exhibit sufficient cutting properties (uniform cut surface) in the cutting step, but the surface of the polyolefine resin layer partially melts due to the heating roller during fixing, causing impaired surface properties or jamming due to paper transport failures, which, therefore, is undesirable.

When the polyolefin resin layer is to be disposed on both surfaces of the raw paper, it is preferred to apply a polyolefin resin layer comprising a polyethylene mixture having the aforesaid composition to both of the surfaces. The polyolefin resin layer may further contain a surfactant, an antistatic agent such as a metal oxide, or the like to control surface electrical resistance. Further, a polyolefin resin layer containing such agents may be used as a layer which also functions as a conductive layer.

According to the present invention, from the viewpoint of obtaining good image quality, an inorganic pigment such as titanium dioxide or the like, a bluing agent, a fluorescence brightener, an antioxidant, or the like can be contained in the polyolefin resin layer when having a single layer structure, or in at least one of the polyolefin resin layers when having a multi layer structure. Of the ingredients, titanium oxide is preferred. When the polyolefin resin layer has a multi-layer structure, a viscosity imparting resin, an adhesive resin, or the like can be contained in the lowermost layer which contacts the raw paper, from the viewpoint of improving adhesive properties with the raw paper. The polyolefin resin layer may suitably further contain an antioxidant, peeling agent, hollow polymer, or the like, if necessary.

When the polyolefin resin layer contains titanium dioxide, the titanium dioxide may be anatase or rutile form without particular limitation. If whiteness is emphasized, the anatase form is preferred. If definitiveness is emphasized, the rutile form is preferred. If it is desired to impart both whiteness and definitiveness, the anatase form and rutile form may be blended together. More over, two polyolefin resin layers which contain titanium oxide may be disposed, in which one of the polyolefin resin layers contains the anatase titanium dioxide and the other contains the rutile titanium dioxide.

The average particle size of the titanium dioxide is preferably from 0.1 μm to 0.4 μm, for example. If the average particle size is less than 0.1 μm, it may be difficult to disperse uniformly in the polyolefin resin layer. If it is more than 0.4 μm, sufficient whiteness may not be obtained, projections may appear on the surface of the polyolefin resin layer, and there may be an adverse effect on image quality.

Preferably, the particle surface of the titanium dioxide is treated with a silane coupling agent. It is preferred that the ends of this silane coupling agent are ethoxy-modified or methoxy-modified. The amount of the silane coupling agent is preferably 0.05% by mass to 2.5% by mass, and more preferably 0.5% by mass to 2.0% by mass, relative to the titanium dioxide. If the amount of the silane coupling agent is less than 0.05% by mass, the effect of surface treatment by the silane coupling agent may be insufficient, and if it is higher than 2.5% by mass, the treatment to the titanium dioxide may be excessive.

The surface of the titanium dioxide is preferably treated with an inorganic surface treatment agent prior to performing the silane coupling agent surface treatment, in order to control the activity of the titanium dioxide pigment. The inorganic surface treatment agent may preferably be at least one of $Al_2O_3$ and $SiO_2$. The amount of the inorganic surface treatment agent (calculated as the anhydride form) is preferably 0.01% by mass to 1.8% by mass, and more preferably 0.2% by mass to 1.0% by mass, relative to the titanium dioxide.

If the titanium dioxide surface is not treated with the inorganic surface treatment agent, the heat resistance of the titanium dioxide is low. Accordingly, if it is used in an extruded laminate around 320° C., there is a possibility that the titanium dioxide turns yellow. Furthermore, as the activity of the titanium dioxide is not controlled, the titanium dioxide particles aggregate. Moreover, there is a possibility that the aggregated titanium dioxide particles remain on a metal filter of from 20 mesh to 400 mesh, which is generally provided in the vicinity of the extrusion laminate outlet to prevent extrusion of foreign matters, and lead to a rise in the pressure inside the extruder.

On the other hand, if the treatment amount of the inorganic surface treatment agent relative to titanium dioxide is 1.8% by mass or more, water is more likely to adhere to the surface of the inorganic surface treatment agent. If it is then used in an extrusion laminate, die lip contamination (die lip build-up) may grow vividly faster.

The titanium dioxide is used in combination with a dispersion assistant such as a metal salt of a higher fatty acid, ethyl derivative of the higher fatty acid, higher fatty acid amide, higher fatty acid or polyolefin wax, and is kneaded and mixed in the resin by a kneading device such as a two roller, three roller, kneader, Banbury mixer, continuous kneader, or the like. The dispersion assistant is preferably a metal salt of stearic acid, and more preferably lead stearate. The resin in which the titanium dioxide is kneaded and mixed is formed into pellets and used as a titanium dioxide pigment master batch.

The concentration of titanium dioxide in the pellet is preferably from 30% to 75% by mass. The concentration of the dispersion assistant in the pellet is preferably from 0.5% to 10% by mass. If the density of titanium dioxide is less than 30% by mass, the bulkiness of the pellet may increase, and if it exceeds 75% by mass, the dispersion properties of titanium dioxide may be impaired and cracks may be formed on the pellet more easily. The master batch which contains titanium dioxide is preferably dried or vacuum dried at 50° C. to 90° C. for two hours or more, prior to usage.

The titanium dioxide content of the polyolefin resin layer is preferably 5% by mass to 50% by mass, and more preferably 8% by mass to 45% by mass. If the titanium dioxide content is less than 5% by mass, resolution deteriorates. If the content is more than 50% by mass, die lines may appear during manufacture of the electrophotographic image-receiving sheet.

Examples of the bluing agent include a generally known ultramarine, cobalt blue, cobalt oxyphosphoric acid, quinacridine pigment, a mixture thereof, and the like. There is no particular limitation on the particle size of the bluing agent and the particle size may be determined according to the purpose. The particle size of the bluing agent is normally preferred to be 0.3 μm to 10 μm. When the bluing agent is used in the uppermost layer of the polyolefin resin layer, the content is preferably from 0.2% by mass to 0.4% by mass. When the bluing agent is used in the lowermost layer, the content is preferably 0% by mass to 0.15% by mass.

The amount of antioxidant contained in the polyolefin resin layer is preferably from 50 ppm to 1,000 ppm, relative to the resin constituting the polyolefin resin layer. Prepared in this way, the master batch containing titanium dioxide and the like is then diluted with the resin forming the polyolefin resin layer and used for an extrusion laminate.

The viscosity imparting resin may be suitably selected from a rosin derivative resin, a terpene resin (such as macromolecular β-pinene), a coumarone-indene resin, a petroleum hydrocarbon resin, and the like. These may be used either alone, or in combination of two or more as a mixture.

Examples of petroleum hydrocarbon resins include an aliphatic petroleum resin, an aromatic petroleum resin, a dicyclopentadiene petroleum resin, a copolymer petroleum resin, a hydrated petroleum resin, an aliphatic petroleum resin, and the like. The aliphatic petroleum resin preferably has 5 carbon atoms. The aromatic petroleum resin preferably has 9 carbon atoms.

The amount of viscosity imparting agent resin is preferably 0.5% by mass to 60% by mass, and more preferably 10% by mass to 35% by mass, relative to the resin forming the polyolefin resin layer. If the amount of viscosity imparting agent resin is less than 0.5% by mass, adhesion may be poor. If the amount is more than 60% by mass, neck-in during manufacture easily occurs.

Examples of the adhesive resin include an ionomer, ethylene vinyl acetate copolymer (EVA), ethylene-acrylic acid copolymer, metal salt thereof, and the like. The blending amount of the adhesive resin is normally preferably 20 parts by mass to 500 parts by mass, and more preferably 50 parts by mass to 200 parts by mass, relative to 100 parts by mass of the resin forming the polyolefin resin layer. The viscosity imparting agent resin and the adhesive resin may be used in combination.

The aforesaid polyolefin resin layer may be formed by melting pellets which contain the heated and melted titanium dioxide. If necessary, the pellets are diluted with a resin which constitutes the polyolefin resin layer, and are melted. Thereafter, the pellets are coated onto the aforesaid raw paper during transporting, by ordinary lamination, sequential lamination, or a lamination method using a single layer or multi-layer extrusion die or laminator such as the heat block type, multi-manifold type, multi-slot type, or the like. The aforesaid polyolefin resin layer may be hence formed.

There is no particular limitation on the shape of the single layer or multi-layer extrusion die, and it may be suitably selected according to the purpose. An under coating treatment can be additionally provided in accordance with a method such as the one of JP-A No. 61-846443 after the activation treatment.

Before coating the resin forming the polyolefin resin layer onto one or both surfaces of the raw paper, it is preferred to give an activation treatment to the raw paper such as corona discharge treatment, flame treatment, glow discharge treatment, plasma treatment, or the like.

The thickness of the polyolefin resin layer formed on the side (surface) of the support on which an image-recording layer is formed is preferably from 10 μm to 60 μm. On the other hand, the thickness of the polyolefin resin layer formed on the side (surface) of the support on which an image-recording layer is not formed is preferably from 10 μm to 50 μm.

On the surface of the uppermost layer of the polyolefin resin which is on the image-recording layer side of the support, printing is performed so as to form a glossy surface, micro-structured surface as disclosed in JP-A No. 55-26507, matte surface, or silky surface. On the surface of the polyolefin resin layer on the side to which no image-recording layer is formed (backside), printing of non-glossy surface is performed. Further, to these printed surfaces, an activating treatment such as corona discharge treatment, flame treatment or the like can be performed.

There is no particular limitation on the method of mixing the high density polyethylene and the low density polyethylene in the polyethylene mixture used for the polyolefin resin layer, and such method may be selected according to the purpose. For example, a predetermined amount of the high density polyethylene and the low density polyethylene, together with various additives if necessary, may be melted and mixed using for example a kneading extruder, heat kneading roller, Banbury mixer, kneader, or the like. The mixture may be pulverized or made into pellets, or these components may be introduced directly into an extruder as a simple blend, and extrusion coated. Other suitable methods may also be used.

Process for Manufacturing Support for Image-Recording Material

The process for manufacturing a support for an image-recording material according to the present invention includes a pressure drying step, a calendering step, and other steps if necessary.

The pressure drying step is a step in which a sheet of raw paper having a water content of from 30% to 70% is pressure dried at a temperature of from 100° C. to 200° C. while a pressure is applied to a surface of the raw paper on which an image-recording layer is to be formed.

Preferably, pressure drying is performed using a pressing machine and at a pressure of from 0.05 MPa to 1.5 MPa.

In such case, drying temperature is more preferably from 110° C. to 180° C. and the pressure from 0.1 MPa to 1.0 MPa.

The calendering step is a step in which the pressure dried sheet is calendered by using at least one calender.

The calendering step is preferably performed by using at least one calender selected from the group consisting of machine calender, soft calender and shoe calender.

Specifically, it is preferable to perform calendering treatment on the side of image-recording surface of the pressure dried raw paper sheet by using a calender having a metal roller with a surface temperature of 110° C. or higher. The surface temperature of the metal roller is preferably 150° C. or higher.

According to the process of the present invention for manufacturing a support for an image-recording material, it is possible to manufacture efficiently a support for an image-recording material which has improved density, elasticity modulus, tensile strength, strength, and the like; which is excellent in dimension stability and smoothness; and with which curling is less likely to occur.

Image-Recording Material

The image-recording material according to the present invention includes at least a support for an image-recording material including at least a raw paper and an image-recording layer disposed on the support, where the support is a support for an image-recording material which at least includes a sheet of pressure-drying-treated raw paper of the present invention.

The image-recording material differs according to the use and type thereof, and examples include an electrophotographic image-receiving material, thermal color development recording material, inkjet recording material, sublimation transfer image-receiving material, silver halide photographic photosensitive material, thermal transfer image-receiving material, and the like.

<Electrophotographic Image-Receiving Material>

The electrophotographic image-receiving material includes a support for an image-recording material according to the present invention and at least one toner-image-receiving layer which is disposed on at least one surface of this support. If necessary, the electrophotographic image-receiving material may further include other layers which may be suitably selected. Examples of the other layers include a surface protection layer, an intermediate layer, an underlayer, a cushion layer, a static control (prevention) layer, a reflection layer, a color tone adjusting layer, a storage property improvement layer, an antistick layer, an anticurl layer, a smoothing layer, and the like. These layers may have a single-layer structure or a laminated structure.

[Toner Image-Receiving Layer]

The toner image-receiving layer receives a color or black toner and forms an image. The toner image-receiving layer has a function to receive toner which forms an image from a developing drum or an intermediate transfer by (static) electricity or pressure in a transferring step, and to fix the image by heat or pressure in a fixing step.

From the viewpoint of giving a near-photographic feel to the electrophotographic image-receiving material according to the present invention, the toner-image-receiving layer must be of low transparency having a light transmittance of 78% or less. The light transmittance is preferably 73% or less, and more preferably 72% or less.

Measurement of the light transmittance may be performed as follows: A polyethylene terephthalate film (thickness: 100 μm) is prepared and a coating of the same thickness is formed thereon, and then the coating is measured using a direct reading hazemeter (HGM-2DP by Suga Test Instruments Co., Ltd.).

The material of the toner-image-receiving layer contains at least a thermoplastic resin, and other components if necessary.

—Thermoplastic Resin—

The thermoplastic resin is not particularly limited, and it may suitably be selected according to the purpose, provided that it is deformable under certain temperatures, for example during fixing, and that it accepts toner. However, a resin similar to the binder resin of a toner is preferable. In many of the toners, polyester resins, styrene, and copolymer resins such as styrene-butyl acrylate are used. In such case, it is preferable to use a polyester resin, styrene, or a copolymer resin such as styrene-butyl acrylate for the thermoplastic resin of the electrophotographic image-receiving paper, and more preferably the thermoplastic resin contains 20% by mass or more of a polyester resin, styrene, or a copolymer resin such as styrene-butyl acrylate. In addition, styrene, styrene-butyl acrylate copolymer, styrene-acrylate copolymer, styrene-methacrylate copolymer, and the like are more preferable.

Examples of the thermoplastic resins are (i) resins each having an ester bond, (ii) polyurethane resins and similar resins, (iii) polyamide resins and similar resins, (iv) polysulfone resins and similar resins, (v) poly(vinyl chloride) resins and similar resins, (vi) poly(vinyl butyral) and similar resins, (vii) polycaprolactone resins and similar resins, and (viii) polyolefin resins and similar resins.

The resins containing one or more ester bonds (i) include, for example, polyester resins obtained by condensation of a dicarboxylic acid component and an alcoholic component, polyacrylate resins or polymethacrylate resins such as polymethylmethacrylate, polybutylmethacrylate, polymethylacrylate, polybutyl acrylate, or the like; polycarbonate resins, polyvinyl acetate resins, styrene acrylate resins, styrene-methacrylate copolymer resins, vinyltoluene acrylate resins, or the like. Specific examples of the dicarboxylic acid component include terephthalic acid, isophthalic acid, maleic acid, fumaric acid, phthalic acid, adipic acid, sebacic acid, azelaic acid, abietic acid, succinic acid, trimellitic acid, pyromellitic acid, and the like. These may be substituted with a sulfonic group, carboxylic group or the like. Specific examples of the alcoholic component include ethylene glycol, diethylene glycol, propylene glycol, bisphenol A, diether derivative of bisphenol A (for example, ethylene oxide diadduct of bisphenol A, propylene oxide diadduct of bisphenol A) or bisphenol S, 2-ethyl cyclohexyldimethanol, neopentyl glycol, dicyclohexyldimethanol or glycerol. These may be substituted with a hydroxyl group or the like.

Examples can also be found in JP-A Nos. 59-101395, 63-7971, 63-7972, 63-7973 and 60-294862.

Examples of commercial products of the polyester resins include Bailon 290, Bailon 200, Bailon 280, Bailon 300, Bailon 103, Bailon GK-140 and Bailon GK-130 from Toyobo Co., Ltd; Tufton NE-382, Tufton U-5, ATR-2009 and ATR-2010 from Kao Corporation; Eritel UE3500, UE3210, XA-8153 from Unitika Ltd.; Polyester TP-220 and R-188 from The Nippon Synthetic Chemical Industry Co., Ltd., and the like.

Examples of commercial products of the above-mentioned acrylic resins include SE-5437, SE-5102, SE-5377, SE-5649, SE-5466, SE-5482, HR-169, HR-124, HR-1127, HR-116, HR-113, HR-148, HR-131, HR-470, HR-634, HR-606, HR-607, LR-1065, LR-574, LR-143, LR-396, LR-637, LR-162, LR-469, LR-216, BR-50, BR-52, BR-60, BR-64, BR-73, BR-75, BR-77, BR-79, BR-80, BR-83, BR-85, BR-87, BR-88, BR-90, BR-93, BR-95, BR-100, BR-101, BR-102, BR-105, BR-106, BR-107, BR-108, BR-112, BR-113, BR-115, BR-116, BR-117 from Mitsubishi Rayon Ltd.; Esrec P SE-0020, SE-0040, SE-0070, SE-0100, SE-1010, SE-1035 from Sekisui Chemical Co., Ltd.; Himer ST95 and ST120 from Sanyo Chemical Industries, Ltd.; and FM601 from Mitsui Chemicals, Inc., and the like.

The polyvinyl chloride resin and the like (v) include, for example, polyvinylidene chloride resin, vinyl chloride-vinyl acetate copolymer resin, vinyl chloride-vinyl propionate copolymer resin, and the like.

The polyvinyl butyral and the like (vi) include, for example, polyol resins, cellulose resins such as ethyl cellulose resin and cellulose acetate resin, and the like. Examples of commercial products include ones by Denki Kagaku Kogyo Kabushikikaisha, Sekisui Chemical Co., Ltd., and the like. For polyvinyl butyral and the like, it is preferable that the amount of polyvinyl butyral contained be 70% by mass or more and the average extent of polymerization is 500 or more, and more preferably 1000 or more. Examples of commercial products include Denka Butyral 3000-1, 4000-2, 5000A, and 6000C by Denki Kagaku Kogyo Kabushikikaisha; S-LEC BL-1, BL-2, BL-S, BX-L, BM-1, BM-2, BM-5, BM-S, BH-3, BX-1, BX-7; and the like.

The polycaprolactone resin and the like (vii) include, for example, styrene-maleic anhydride resin, polyacrylonitrile resin, polyether resin, epoxy resin, phenol resin, and the like.

The polyolefin resin and the like (viii) include, for example, polyethylene resin, polypropylene resin, copolymer resins of olefins such as ethylene, propylene, or the like with other vinyl monomers, acrylic resins, and the like.

The thermoplastic resins may be used alone or in combination of two or more, and in addition, a mixture, a copolymer of these resins, and the like may be used.

The thermoplastic resin preferably satisfies toner image-receiving layer properties, which will be described later, when formed into a toner image-receiving layer, and more preferably satisfies the toner image-receiving layer properties by itself. It is also preferable to use in combination two or more resins which have different toner image-receiving layer properties.

The thermoplastic resin preferably has a molecular weight that is larger than that of a thermoplastic resin used in the toner. However, according to the relationship of the thermodynamic properties of the thermoplastic resin used in the toner and the properties of the resin used in the toner image-receiving layer, the relationship of the molecular weights as described above is not necessarily preferable. For example, when a softening temperature of the resin used in the toner image-receiving layer is higher than that of the thermoplastic resin used in the toner, there are cases in which molecular weight of the resin used in the toner image-receiving layer is preferably the same or smaller.

It is also preferred that the thermoplastic resin be a mixture of resins with identical compositions having different average molecular weights. The preferable relationship with molecular weights of thermoplastic resins used in toners is disclosed in JP-A No. 08-334915.

Molecular weight distribution of the thermoplastic resin is preferably wider than that of the thermoplastic resin used in the toner.

It is preferred that the thermoplastic resin satisfies the physical properties disclosed in JP-A Nos. 05-127413, 08-194394, 08-334915, 08-334916, 09-171265, 10-221877, and the like.

It is particularly preferable that the thermoplastic resin used in a toner image-receiving layer be an aqueous resin such as water-soluble resin, water-dispersible resin, or the like for the following reasons (1) and (2).

(1) Since no organic solvent is discharged in coating and drying steps, it is excellent in environmental preservation and workability. (2) Since many release agents such as wax are difficult to dissolve in a solvent at room temperature, often they are dispersed in a solvent (water or an organic solvent) before use. Further, an aqueous dispersion is more stable and is excellently suitable for a manufacturing process. In addition, with aqueous coating, wax bleeds on the surface more easily during the process of coating and drying, and the effects of a release agent (offset resistance, adhesion resistance, and the like) is facilitated more easily.

The aqueous resin is not particularly limited with regards to its composition, bonding structure, molecular weight, molecular weight distribution, and formation, provided that it is an aqueous resin, water-dispersible resin, or the like. Examples of substituting groups which render a resin aqueous include sulfonic acid group, hydroxyl group, carboxylic acid group, amino group, amide group, ether group, and the like.

Examples of the water-soluble resins are given on page 26 of Research Disclosure No. 17,643, page 651 of Research Disclosure No. 18,716, pp. 873-874 of Research Disclosure No. 307,105, and pp. 71-75 of JP-A No. 64-13546.

Specific examples include a vinyl pyrrolidone-vinyl acetate copolymer, styrene-vinyl pyrrolidone copolymer, styrene-maleic anhydride copolymer, water-soluble polyester, water-soluble acrylic, water-soluble polyurethane, water-soluble nylon, a water-soluble epoxy resin, and the like. Gelatin may be selected from lime treated gelatin, acid treated gelatin, or so-called delimed gelatin in which the amount of calcium and the like is reduced, and it may also be used in combination. Examples of commercial products of aqueous polyester include various Plascoat products by Goo Chemical Co., Ltd., Finetex ES series by Dainippon Ink and Chemicals Inc., and the like; and those of aqueous acrylic resins include Jurymer AT series by Nihon Junyaku Co., Ltd., Finetex 6161 and K-96 by Dainippon Ink and Chemicals Inc., Hiros NL-1189 and BH-997 by Seiko Chemical Industries Co., Ltd., and the like.

The water-dispersible resin may suitably be selected from water-dispersed resins such as water-dispersed acrylic resin, water-dispersed polyester resin, water-dispersed polystyrene resin, water-dispersed urethane resin, and the like; emulsions such as acrylic resin emulsion, polyvinyl acetate emulsion, SBR (styrene butadiene rubber) emulsion, and the like; resins and emulsions in which the thermoplastic resins of (i) to (viii) are water dispersed; and copolymers thereof, mixtures thereof, and those which are cation-modified. Two or more of these may be used in combination.

Examples of commercial products of the water-dispersible resins include, for polyester resins, Vylonal series by Toyobo Co., Ltd., Pesresin A series by Takamatsu Oil & Fat Co., Ltd., Tuftone UE series by Kao Corp., Nichigo Polyester WR series by Nippon Synthetic Chemical Industry Co., Ltd., Elitel series by Unitika Ltd., and the like; and for acrylic resins, Hiros XE, KE, and PE series by Seiko Chemical Industries Co., Ltd., Jurymer ET series by Nihon Junyaku Co., Ltd., and the like.

The minimum film-forming temperature (MFT) of the polymer is preferably room temperature or higher, from the viewpoint of pre-print storage, and preferably 100° C. or lower, from the viewpoint of fixing toner particles.

A content of the thermoplastic resin in the toner-image-receiving layer is preferably 50% by mass or more, and more preferably from 50% by mass to 90% by mass.

Suitable components of the toner-image-receiving layer other than the thermoplastic resin includes, for example, a colorant such as a pigment or dye from the viewpoint that it can easily adjust the light transmittance of the toner-image-receiving layer to be within the numeric range as previously described and in particular that it is possible to adjust the whiteness of the toner-image-receiving layer. Other components include various additives which are added in order to improve thermodynamic properties of a toner-image-receiving layer, for example, plasticizer, releasing agent, filler, cross-linking agent, electrification control agent, emulsifier, dispersant, and the like.

—Colorant—

Examples of colorants include fluorescent whitening agents, white pigments, colored pigments, dyes, and the like.

The fluorescent whitening agent has absorption in the near-ultraviolet region, and is a compound which emits fluorescence at 400 nm to 500 nm. The various fluorescent whitening agent known in the art may be used without any particular limitation. Examples of the fluorescent whitening agent include the compounds described in *The Chemistry of Synthetic Dyes* Volume V, Chapter 8 edited by K. VeenRataraman. Specific examples of the fluorescent whitening agent include stilbene compounds, coumarin compounds, biphenyl compounds, benzo-oxazoline compounds, naphthalimide compounds, pyrazoline compounds, carbostyryl compounds, and the like. Examples of the commercial fluorescent whitening agents include WHITEX PSN, PHR, HCS, PCS, and B from Sumitomo Chemicals, UVITEX-OB from Ciba-Geigy, Co., Ltd., and the like.

Examples of the white pigments include the inorganic pigments such as titanium oxide, calcium carbonate, and the like.

Examples of the colored pigments include various pigments and azo pigments described in JP-A No. 63-44653, (for example, azo lakes such as carmine 6B and red 2B, insoluble azo compounds such as monoazo yellow, disazo yellow, pyrazolo orange, Balkan orange, and condensed azo compounds such as chromophthal yellow and chromophthal red), polycyclic pigments (for example, phthalocyanines such as copper phthalocyanine blue and copper phthalocyanine green), thioxadines such as thioxadine violet, isoindolinones such as isoindolinone yellow, surenes such as perylene, perinon, hulavanthoron and thioindigo, lake pigments (for example, malachite green, rhodamine B, rhodamine G and Victoria blue B), and inorganic pigment (for example, oxide, titanium dioxide, iron oxide red, sulfate; settling barium sulfate, carbonate; settling calcium carbonate, silicate; hydrous silicate, silicic anhydride, metal powder; alminium powder, bronze powder, zinc powder, carbon black, chrome yellow, iron blue, or the like) and the like.

These may be used either alone, or in combination of two or more. Of these, titanium oxide is particularly preferred as the pigment.

There is no particular limitation on the form of the pigment. However, hollow particles are preferred from the viewpoint that they have excellent heat conductivity (low heat conductivity) during image fixing.

The various dyes including oil-soluble dyes, water-insoluble dyes, and the like may be used as the dye.

Examples of oil-soluble dyes include anthraquinone compounds, azo compounds, and the like.

Examples of water-insoluble dyes include vat dyes such as C.I.Vat violet 1, C.I.Vat violet 2, C.I.Vat violet 9, C.I.Vat violet 13, C.I.Vat violet 21, C.I.Vat blue 1, C.I.Vat blue 3, C.I.Vat blue 4, C.I.Vat blue 6, C.I.Vat blue 14, C.I.Vat blue 20 and C.I.Vat blue 35, or the like; disperse dyes such as C.I. disperse violet 1, C.I. disperse violet 4, C.I. disperse violet 10, C.I. disperse blue 3, C.I. disperse blue 7, C.I. disperse blue 58, or the like; and other dyes such as C. I. solvent violet 13, C.I. solvent violet 14, C.I. solvent violet 21, C.I.

solvent violet 27, C.I. solvent blue 11, C.I. solvent blue 12, C.I. solvent blue 25, C.I. solvent blue 55, or the like.

Colored couplers used in silver halide photography may also be preferably used.

A content of the colorant in the toner image-receiving layer (surface) is preferably 0.1 $g/m^2$ to 8 $g/m^2$, and more preferably 0.5 $g/m^2$ to 5 $g/m^2$.

If the content of colorant is less than 0.1 $g/m^2$, the light transmittance in the toner image-receiving layer becomes high. If it is more than 8 $g/m^2$, handling becomes more difficult, due to crack and adhesive resistance.

—Releasing Agent—

The releasing agent can be blended to the toner image-receiving layer in order to prevent offset of the toner image-receiving layer. Various types of the releasing agent can be used and may be selected according to the purpose as long as it is able to form a layer of the releasing agent on a surface of the toner image-receiving layer by being heated and melted so as to deposit and to remain on the surface of the toner image-receiving layer, and by being cooled and solidified so as to form a layer of the releasing agent, thereafter.

The releasing agent can be at least one of silicone compounds, fluorine compounds, waxes, and matting agents. Among them, at least one selected from silicone oils, polyethylene waxes, carnauba waxes, silicone particles, and polyethylene wax particles is preferably used.

The releasing agent may for example be a compound described in *Kaitei—Wakkusu no seishitsu to ouyou* [Properties and Applications of Wax (Revised)] by Saiwai Publishing, or in the Silicone Handbook published by THE NIKKAN KOGYO SHIMBUN. Also, the silicone compounds, fluorine compounds and wax in the toners mentioned in Japanese Patent Application Publication (JP-B) No. 59-38581, Japanese Patent Application Publication (JP-B) No. 04-32380, Japanese Patent (JP-B) No. 2838498, JP-B No. 2949558, Japanese Patent Application Laid-Open (JP-A) No. 50-117433, No. 52-52640, No. 57-148755, No. 61-62056, No. 61-62057, No. 61-118760, and JP-A No. 0242451, No. 0341465, No. 04-212175, No. 04-214570, No. 04-263267, No. 05-34966, No. 05-119514, No. 06-59502, No. 06-161150, No. 06-175396, No. 06-219040, No. 06-230600, No. 06-295093, No. 07-36210, No. 0743940, No. 07-56387, No. 07-56390, No. 07-64335, No. 07-199681, No. 07-223362, No. 07-287413, No. 08-184992, No. 08-227180, No. 08-248671, No. 08-248799, No. 08-248801, No. 08-278663, No. 09-152739, No. 09-160278, No. 09-185181, No. 09-319139, No. 09-319143, No. 10-20549, No. 10-48889, No. 10-198069, No. 10-207116, No. 11-2917, No. 11-44969, No. 11-65156, No. 11-73049 and No. 11-194542 may be used. These compounds can also be used in combination of two or more.

Specifically, examples of the silicone compounds include non-modified silicone oils (specifically, dimethyl siloxane oil, methyl hydrogen silicone oil, phenyl methyl-silicone oil, or commercial products such as KF-96, KF-96L, KF-96H, KF-99, KF-50, KF-54, KF-56, KF-965, KF-968, KF-994, KF-995 and HIVAC F-4, F-5 from Shin-Etsu Chemical Co., Ltd.; SH200, SH203, SH490, SH510, SH550, SH710, SH704, SH705, SH7028A, SH7036, SM7060, SM7001, SM7706, SH7036, SH8710, SH1107 and SH8627 from Dow Corning Toray Silicone Co., Ltd.; and TSF400, TSF401, TSF404, TSF405, TSF431, TSF433, TSF434, TSF437, TSF450 series, TSF451 series, TSF456, TSF458 series, TSF483, TSF484, TSF4045, TSF4300, TSF4600, YF33 series, YF-3057, YF-3800, YF-3802, YF-3804, YF-3807, YF-3897, XF-3905, XS69-A1753, TEX100, TEX101, TEX102, TEX103, TEX104, TSW831, and the like from GE Toshiba Silicones), amino-modified silicone oils (for example, KF-857, KF-858, KF-859, KF-861, KF-864 and KF-880 from Shin-Etsu Chemical Co., Ltd., SF8417 and SM8709 from Dow Corning Toray Silicone Co., Ltd., and TSF4700, TSF4701, TSF4702, TSF4703, TSF4704, TSF4705, TSF4706, TEX150, TEX151 and TEX154 from GE Toshiba Silicones), carboxy-modified silicone oils (for example, BY16-880 from Dow Corning Toray Silicone Co., Ltd., TSF4770 and XF42-A9248 from GE Toshiba Silicones), carbinol-modified silicone oils (for example, XF42-B0970 from GE Toshiba Silicones), vinyl-modified silicone oils (for example, XF40-A1987 from GE Toshiba Silicones), epoxy-modified silicone oils (for example, SF8411 and SF8413 from Dow Corning Toray Silicone Co., Ltd.; TSF3965, TSF4730, TSF4732, XF42-A4439, XF42-A4438, XF42-A5041, XC96-A4462, XC96-A4463, XC96-A4464 and TEX170 from GE Toshiba Silicones), polyether-modified silicone oils (for example, KF-351 (A), KF-352 (A), KF-353 (A), KF-354 (A), KF-355 (A), KF-615(A), KF-618 and KF-945 (A) from Shin-Etsu Chemical Co., Ltd.; SH3746, SH3771, SF8421, SF8419, SH8400 and SF8410 from Dow Corning Toray Silicone Co., Ltd.; TSF4440, TSF4441, TSF4445, TSF4446, TSF4450, TSF4452, TSF4453 and TSF4460 from GE Toshiba Silicones), silanol-modified silicone oils, methacryl-modified silicone oil, mercapto-modified silicone oil, alcohol-modified silicone oil (for example, SF8427 and SF8428 from Dow Corning Toray Silicone Co., Ltd., TSF4750, TSF4751 and XF42-B0970 from GE Toshiba Silicones), alkyl-modified silicone oils (for example, SF8416 from Dow Corning Toray Silicone Co., Ltd., TSF410, TSF411, TSF4420, TSF4421, TSF4422, TSF4450, XF42-334, XF42-A3160 and XF42-A3161 from GE Toshiba Silicones), fluorine-modified silicone oils (for example, FS1265 from Dow Corning Toray Silicone Co., Ltd., and FQF501 from GE Toshiba Silicones), silicone rubbers and silicone fine particles (for example, SH851U, SH745U, SH55UA, SE4705U, SH502 UA&B, SRX539U, SE6770 U-P, DY38-038, DY38-047, Torayfil F-201, F-202, F-250, R-900, R-902A, E-500, E-600, E-601, E-506, BY29-119 from Dow Corning Toray Silicone Co., Ltd.; Tospearl 105, Tospearl 120, Tospearl 130, Tospearl 145, Tospearl 240 and Tospearl 3120 from GE Toshiba Silicones), silicone-modified resins (specifically, olefin resins, polyester resins, vinyl resins, polyamide resins, cellulosic resins, phenoxy resins, vinyl chloride-vinyl acetate resins, urethane resins, acrylic resins, styrene-acrylic resins, compounds in which copolymerization resins thereof are modified by silicone, and the like), and the like. Examples of the commercial products include Daiallomer SP203V, SP712, SP2105 and SP3023 from Dainichiseika Color & Chemicals Mfg. Co., Ltd.; Modiper FS700, FS710, FS720, FS730 and FS770 from NOF Corp.; Symac US-270, US-350, US-352, US-380, US-413, US450, Reseda GP-705, GS-30, GF-150 and GF-300 from TOAGOSEI CO., LTD.; SH997, SR2114, SH2104, SR2115, SR2202, DCI-2577, SR2317, SE4001U, SRX625B, SRX643, SRX439U, SRX488U, SH804, SH840, SR2107 and SR2115 from Dow Corning Toray Silicone Co., Ltd., YR3370, TSR1122, TSR102, TSR108, TSR116, TSR117, TSR125A, TSR127B, TSR144, TSR180, TSR187, YR47, YR3187, YR3224, YR3232, YR3270, YR3286, YR3340, YR3365, TEX152, TEX153, TEX171 and TEX172 from GE Toshiba Silicones), and reactive silicone compounds (specifically, addition reaction type, peroxide-curing type and ultraviolet radiation curing type. Commercial examples thereof include: TSR1500, TSR1510, TSR1511, TSR1515, TSR1520, YR3286, YR3340, PSA6574, TPR6500, TPR6501, TPR6600, TPR6702, TPR6604, TPR6700, TPR6701, TPR6705, TPR6707, TPR6708, TPR6710, TPR6712, TPR6721, TPR6722, UV9300, UV9315, UV9425, UV9430, XS56-A2775, XS56-A2982, XS56-A3075, XS56-A3969, XS56-A5730, XS56-A8012, XS56-B1794, SL6100, SM3000, SM3030, SM3200 and YSR3022 from GE Toshiba Silicones), and the like.

Examples of the fluorine compounds include fluorine oils (for example, Daifluoryl #1, Daifluoryl # 3, Daifluoryl #10, Daifluoryl #20, Daifluoryl #50, Daifluoryl #100, Unidyne TG-440, TG-452, TG-490, TG-560, TG-561, TG-590, TG-652, TG-670U, TG-991, TG-999, TG-3010, TG-3020 and TG-3510 from Daikin Industries, Ltd.; MF-100, MF-110, MF-120, MF-130, MF-160 and MF-160E from Tohkem Products; S-111, S-112, S-113, S-121, S-131, S-132, S-141 and S-145 from Asahi Glass Co., Ltd.; and, FC430 and FC-431 from DU PONT-MITSUI FLUORO-CHEMICALS COMPANY, LTD.), fluoro rubbers (for example, LS63U from Dow Corning Toray Silicone Co., Ltd.), fluorine-modified resins (for example, Modepa F200, F220, F600, F220, F600, F2020, F3035 from Nippon Oils and Fats; Diaroma FF203 and FF204 from Dai Nichi Pure Chemicals; Saflon S-381, S-383, S-393, SC-101, SC-105, KH-40 and SA-100 from Asahi Glass Co., Ltd.; EF-351, EF-352, EF-801, EF-802, EF-601, TFE, TFEA, TFEMA and PDFOH from Tohkem Products; and THV-200P from Sumitomo 3M), fluorine sulfonic acid compound (for example, EF-101, EF-102, EF-103, EF-104, EF-105, EF-112, EF-121, EF-122A, EF-122B, EF-122C, EF-123A, EF-123B, EF-125M, EF-132, EF-135M, EF-305, FBSA, KFBS and LFBS from Tohkem Products), fluorosulfonic acid, and fluorine acid compounds or salts (specifically, anhydrous fluoric acid, dilute fluoric acid, fluoroboric acid, zinc fluoroborate, nickel fluoroborate, tin fluoroborate, lead fluoroborate, copper fluoroborate, fluorosilicic acid, fluorinated potassium titanate, perfluorocaprylic acid, ammonium perfluorooctanoate, and the like), inorganic fluorides (specifically, aluminum fluoride, potassium fluoride, fluorinated potassium zirconate, fluorinated zinc tetrahydrate, calcium fluoride, lithium fluoride, barium fluoride, tin fluoride, potassium fluoride, acid potassium fluoride, magnesium fluoride, fluorinated titanic acid, fluorinated zirconic acid, ammonium hexafluorinated phosphoric acid, potassium hexafluorinated phosphoric acid, and the like).

Examples of the wax include synthetic hydrocarbon, modified wax, hydrogenated wax, natural wax, and the like.

Examples of the synthetic hydrocarbon include polyethylene wax (for example, POLYRON A, 393, and H-481 from Chukyo Yushi Co., Ltd.; SUNWAX E-310, E-330, E-250P, LEL-250, LEL-800, LEL400P, from SANYO KASEI Co., Ltd.), polypropyrene wax (for example, VISCOL 330-P, 550-P, 660-P from SANYO KASEI Co., Ltd.), Fischer toropush wax (for example, FT100, and FT-0070, from Nippon Seiro Co., Ltd.), an acid amide compound or an acid imide compound (specifically, stearic acid amide, anhydrous phthalic acid imide, or the like; for example, CELLOSOL 920, B-495, HYMICRON G-270, G-110, HYDRINE D-757 from Chukyo Yushi Co., Ltd.), and the like.

Examples of the modified wax include amine-modified polypropyrene (for example, QN-7700 from SANYO KASEI Co., Ltd.), acrylic acid-modified wax, fluorine-modified wax, olefin-modified wax, urethane wax (for example, NPS-6010, and HAD-5090 from Nippon Seiro Co., Ltd.), alcohol wax (for example, NPS-9210, NPS-9215, OX-1949, XO-020T from Nippon Seiro Co., Ltd.), and the like.

Examples of the hydrogenated wax include cured castor oil (for example, castor wax from Itoh Oil Chemicals Co., Ltd.), castor oil derivatives (for example, dehydrated castor oil DCO, DCO Z-1, DCO Z-3, castor oil aliphatic acid CO-FA, ricinoleic acid, dehydrated castor oil aliphatic acid DCO-FA, dehydrated castor oil aliphatic acid epoxy ester D4 ester, castor oil urethane acrylate CA-10, CA-20, CA-30, castor oil derivative MINERASOL S-74, S-80, S-203, S42X, S-321, special castor oil condensation aliphatic acid MINERASOL RC-2, RC-17, RC-55, RC-335, special castor oil condensation aliphatic acid ester MINERASOL LB-601, LB-603, LB-604, LB-702, LB-703, #11 and L-164 from Itoh Oil Chemicals Co., Ltd.), stearic acid (for example, 12-hydroxystearic acid from Itoh Oil Chemicals Co., Ltd.), lauric acid, myristic acid, palmitic acid, behenic acid, sebacic acid (for example, sebacic acid from Itoh Oil Chemicals Co., Ltd.), undecylenic acid (for example, undecylenic acid from Itoh Oil Chemicals Co., Ltd.), heptyl acids (heptyl acids from Itoh Oil Chemicals Co., Ltd.), maleic acid, high grade maleic oils (for example, HIMALEIN DC-15, LN-10, LN-00-15, DF-20 and SF-20 from Itoh Oil Chemicals Co., Ltd.), blown oils (for example, selbonol #10, #30, #60, R-40 and S-7 from Itoh Oil Chemicals Co., Ltd.), cyclopentadieneic oil (CP oil and CP oil-S from Itoh Oil Chemicals Co., Ltd., or the like), and the like.

The natural wax is preferably at least one wax selected from vegetable wax, animal wax, mineral wax, and petroleum wax, among which vegetable wax is particularly preferable. The natural wax is also preferably a water-dispersible wax, from the viewpoint of compatibility when a water-dispersible thermoplastic resin is used as the thermoplastic resin in the toner image-receiving layer.

Examples of the vegetable wax include carnauba wax (for example, EMUSTAR AR-0413 from Nippon Seiro Co., Ltd., and Cellusol 524 from Chukyo Yushi Co., Ltd.), castor oil (purified castor oil from Itoh Oil Chemicals Co., Ltd.), rapeseed oil, soybean oil, Japan tallow, cotton wax, rice wax, sugarcane wax, candellila wax, Japan wax, jojoba oil, and the like. Of these, carnauba wax having a melting point of 70° C. to 95° C. is particularly preferable from viewpoints of providing an electrophotographic image-receiving sheet which is excellent in anti-offset properties, adhesive resistance, paper transporting properties, gloss, is less likely to cause crack and splitting, and is capable of forming a high quality image.

Examples of the animal wax include bees wax, lanolin, spermaceti, whale oil, wool wax, and the like.

Examples of the mineral wax include montan wax, montan ester wax, ozokerite, ceresin, and the like, aliphatic acid esters (Sansosizer-DOA, AN-800, DINA, DIDA, DOZ, DOS, TOTM, TITM, E-PS, nE-PS, E-PO, E-4030, E-6000, E-2000H, E-9000H, TCP, C-1100, and the like, from New Japan Chemical Co., Ltd.), and the like. Of these, montan wax having a melting point of 70° C. to 95° C. is particularly preferable from viewpoints of providing an electrophotographic image-receiving sheet which is excellent in anti-offset properties, adhesive resistance, paper transporting properties, gloss, is less likely to cause crack and splitting, and is capable of forming a high quality image.

Examples of the petroleum wax include paraffin wax (for example, Paraffin wax 155, Paraffin wax 150, Paraffin wax 140, Paraffin wax 135, Paraffin wax 130, Paraffin wax 125, Paraffin wax 120, Paraffin wax 115, HNP-3, HNP-5, HNP-9, HNP-10, HNP-11, HNP-12, HNP-14G, SP-0160, SP-0145, SP-1040, SP-1035, SP-3040, SP-3035, NPS-8070, NPS-L-70, OX-2151, OX-2251, EMUSTAR-0384 and EMUSTAR-0136 from Nippon Oils and Fats Co., Ltd.; Cellosol 686, Cellosol 428, Cellosol 651-A, Cellosol A, H-803, B-460, E-172, E-866, K-133, hydrin D-337 and E-139 from Chukyo Yushi Co., Ltd.; 125° paraffin, 125° FD, 130° paraffin, 135° paraffin, 135° H, 140° paraffin, 140° N, 145° paraffin and paraffin wax M from Nippon Oil Corporation), or a microcrystalline wax (for example, Hi-Mic-2095, Hi-Mic-3090, Hi-Mic-1080, Hi-Mic-1070, Hi-Mic-2065, Hi-Mic-1045, Hi-Mic-2045, EMUSTAR-0001 and EMUSTAR-042X from Nippon Oils and Fats Co., Ltd; Cellosol 967, M, from Chukyo Yushi Co., Ltd.; 155 Microwax and 180 Microwax from Nippon Oil Corporation), and petrolatum (for example, OX-1749, OX-0450, OX-0650B, OX-0153, OX-261BN, OX-0851, OX-0550, OX-0750B, JP-1500, JP-056R and JP-011P from Nippon Oils and Fats Co., Ltd.), and the like.

A content of the natural wax in the toner image-receiving layer (a surface) is preferably 0.1 g/m$^2$ to 4 g/m$^2$, and more preferably 0.2 g/m$^2$ to 2 g/m$^2$. If the content is less than 0.1 g/m$^2$, the anti-offset properties and the adhesive resistance deteriorate. If the content is more than 4 g/m$^2$, the quality of an image may deteriorate because of the excessive amount of wax.

The melting point of the natural wax is preferably 70° C. to 95° C., and more preferably 75° C. to 90° C., from a viewpoint of anti-offset properties and paper transporting properties.

The matting agent can be selected from any known matting agent. Solid particles used as the matting agent can be classified into inorganic particles and organic particles. Specifically, the inorganic matting agents may be oxides (for example, silicon dioxide, titanium oxide, magnesium oxide, aluminum oxide), alkaline earth metal salts (for example, barium sulfate, calcium carbonate, and magnesium sulfate), silver halides (for example, silver chloride, and silver bromide), glass, and the like.

Examples of the inorganic matting agents can be found, for example, in West German Patent No. 2529321, the U.K. Patent Nos. 760775, 1260772, and the U.S. Pat. Nos. 1,201,905, 2,192,241, 3,053,662, 3,062,649, 3,257,206, 3,322,555, 3,353,958, 3,370,951, 3,411,907, 3,437,484, 3,523,022, 3,615,554, 3,635,714, 3,769,020, 4,021,245 and 4,029,504.

Materials of the organic matting agent include starch, cellulose ester (for example, cellulose-acetate propionate), cellulose ether (for example, ethyl cellulose) and a synthetic resin. It is preferred that the synthetic resin is insoluble or difficult to become solved. Examples of synthetic resins that are insoluble or of low solubility in water include poly (meth)acrylates (for example, polyalkyl(meth)acrylate, polyalkoxyalkyl(meth)acrylate, polyglycidyl(meth)acrylate), poly(meth)acrylamide, polyvinyl ester (for example, polyvinyl acetate), polyacrylonitrile, polyolefins (for example, polyethylene), polystyrene, benzoguanamine resin, formaldehyde condensation polymer, epoxy resin, polyamide, polycarbonate, phenolic resin, polyvinyl carbazole, polyvinylidene chloride, and the like.

Copolymers which combine the monomers used in the above polymers, may also be used.

In the case of the copolymers, a small amount of hydrophilic repeating units may be included. Examples of monomers which constitute these hydrophilic repeating units include acrylic acid, methacrylic acid, a, β-unsaturated dicarboxylic acid, hydroxyalkyl(meth)acrylate, sulfoalkyl (meth)acrylate, styrene sulfonic acid, and the like.

Examples of the organic matting agents can be found, for example, in the U.K. Patent No. 1055713, the U.S. Pat. Nos. 1,939,213, 2,221,873, 2,268,662, 2,322,037, 2,376,005, 2,391,181, 2,701,245, 2,992,101, 3,079,257, 3,262,782, 3,443,946, 3,516,832, 3,539,344, 3,591,379, 3,754,924 and 3,767,448, and JP-A Nos. 49-106821, and 57-14835.

Also, two or more types of solid particles may be used in combination. The average particle size of the solid particles may suitably be, for example, 1 μm to 100 μm, and is more preferably 4 μm to 30 μm. The usage amount of the solid particles may suitably be 0.01 g/m$^2$ to 0.5 g/m$^2$, and is more preferably 0.02 g/m$^2$ to 0.3 g/m$^2$.

The release agent of the present invention which is added to a toner image-receiving layer may also use derivatives, oxides, refined products, or mixtures of these. These may also have reactive substituents.

The melting point (° C.) of the releasing agent is preferably 70° C. to 95° C., and more preferably 75° C. to 90° C., from the viewpoints of anti-offset properties and paper transport properties.

The releasing agent is also preferably a water-dispersible releasing agent, from the viewpoint of compatibility when a water-dispersible thermoplastic resin is used as the thermoplastic resin in the toner image-receiving layer.

The content of the releasing agent in the toner image-receiving layer is preferably 1% by mass to 20% by mass, more preferably 1% by mass to 8.0% by mass, and still more preferably 1% by mass to 5.0% by mass.

—Plasticizers—

The plasticizers known in the art may be used without any particular limitation. These plasticizers have the effect of adjusting the fluidity or softening of the toner image-receiving layer due to one of heat and pressure during toner fixing.

The plasticizer may be selected by referring to *Kagaku binran* [Chemical Handbook] (ed. The Chemical Society of Japan, Maruzen), *Kasozai—Sono riron to ouyou* [Plasticizers—Theory and Application] (ed. Koichi Murai, Saiwai Shobo), *Kasozai no kenkyu—jou* [The Study of Plasticizers, Part 1] and *Kasozai no kenkyu—ge* [The Study of Plasticizers, Part 2] (ed. Polymer Chemistry Association), or *Binran—Gomu purasuchikku haigou yakuhin* [Handbook of Rubber and Plastics Blending Agents] (ed. Rubber Digest Co.), or the like.

Examples of the plasticizers include phthalic esters, phosphate esters, aliphatic acid esters, abiethyne acid ester, abietic acid ester, sebacic acid esters, azelinic ester, benzoates, butylates, epoxy aliphatic acid esters, glycolic acid esters, propionic acid esters, trimellitic acid esters, citrates, sulfonates, carboxylates, succinic acid esters, maleates, fumaric acid esters, phthalic acid esters, stearic acid esters, and the like; amides (for example, aliphatic acid amides and sulfoamides); ethers; alcohols; lactones; polyethyleneoxy; and the like (See, for example, JP-A Nos. 59-83154, 59-178451, 59-178453, 59-178454, 59-178455, 59-178457, 62-174754, 62-245253, 61-209444, 61-200538, 62-8145, 62-9348, 62-30247, 62-136646, 62-174754, 62-245253, 61-209444, 61-200538, 62-8145, 62-9348, 62-30247, 62-136646 and 02-235694, and the like). The plasticizers can be mixed into a resin.

The plasticizers may be polymers having relatively low molecular weight. In this case, it is preferred that the molecular weight of the plasticizer is lower than the molecular weight of the binder resin to be plasticized. Preferably, plasticizers have a molecular weight of 15000 or less, or more preferably 5000 or less. When a polymer plasticizer is used as the plasticizer, the kind of the polymer of the polymer plasticizer is preferably the same as that of the binder resin to be plasticized. For example, when the polyester resin is plasticized, polyester having low molecular weight is preferable. Further, oligomers may also be used as plasticizers. Apart from the compounds mentioned above, there are commercially products such as, for example, Adecasizer PN-170 and PN-1430 from Asahi Denka Co., Ltd.; PARAPLEX-G-25, G-30 and G-40 from C.P. Hall; and, rosin ester 8 L-JA, ester R-95, pentalin 4851, FK 115, 4820, 830, Ruizol 28-JA, Picolastic A75, Picotex LC and Cristalex 3085 from Rika Hercules, Inc, and the like.

The plasticizer can be used as desired to relax stress and distortion (physical distortions of elasticity and viscosity, and distortions of mass balance in molecules, binder main chains or pendant portions) which are produced when toners are embedded in the toner image-receiving layer.

The plasticizer may be dispersed in micro in the toner image-receiving layer. The plasticizer may also be dispersed in micro in a state of sea-island, in the toner image-receiving layer. The plasticizer may present in the toner image-receiving layer in a state of sufficiently mixed with other components such as binder or the like.

The content of plasticizer in the toner image-receiving layer is preferably 0.001% by mass to 90% by mass, more preferably 0.1% by mass to 60% by mass, and still more preferably 1% by mass to 40% by mass.

The plasticizer may be used for the purpose of adjusting slidability (improvement of transportability by reducing friction), improving fixing part offset (release of toner or layer to the fixing part), adjusting electrification (formation of a toner electrostatic image), and the like.

The filler may be an organic or inorganic filler. Reinforcers for binder resins, bulking agents and reinforcements known in the art may be used. The filler may be selected, referring into "Handbook of Rubber and Plastics Additives" (ed. Rubber Digest Co.), "Plastics Blending Agents—Basics and Applications" (New Edition) (Taisei Co.), "The Filler Handbook" (Taisei Co.), or the like.

As the filler, various inorganic fillers (or inorganic pigments) can be used suitably. Examples of inorganic fillers (inorganic pigments) include silica, alumina, titanium dioxide, zinc oxide, zirconium oxide, micaceous iron oxide, white lead, lead oxide, cobalt oxide, strontium chromate, molybdenum pigments, smectite, magnesium oxide, calcium oxide, calcium carbonate, mullite, and the like. Of these, silica and alumina are preferred. These may be used either alone, or in combination of two or more. It is preferred that the filler has a small particle diameter. If the particle diameter is large, the surface of the toner image-receiving layer tends to become rough.

Examples of the silica include spherical silica and amorphous silica. The silica may be synthesized by the dry method, wet method or aerogel method. The surface of the hydrophobic silica particles may also be treated by trimethylsilyl groups or silicone. Colloidal silica is preferred. The average particle diameter of the silica is preferably 4 nm to 120 nm, and more preferably 4 nm to 90 nm.

The silica is preferably porous. The average pore size of porous silica is preferably 50 nm to 500 nm. The average pore volume per mass of porous silica is preferably 0.5 ml/g to 3 ml/g, for example.

The alumina includes anhydrous alumina and hydrated alumina. Examples of crystallized anhydrous aluminas which may be used, are $\alpha$, $\beta$, $\gamma$, $\delta$, $\zeta$, $\eta$, $\theta$, $\kappa$, $\rho$, or $\chi$. Hydrated alumina is preferred to anhydrous alumina. The hydrated alumina may be a monohydrate or trihydrate. Monohydrates include pseudo-boehmite, boehmite and diaspore. Trihydrates include gibbsite and bayerite. The average particle diameter of alumina is preferably 4 nm to 300 nm, and more preferably 4 nm to 200 nm. Porous alumina is preferred. The average pore size of porous alumina is preferably 50 nm to 500 nm. The average pore volume per mass of porous alumina is preferably from 0.3 ml/g to 3 ml/g.

The alumina hydrate can be synthesized by the sol-gel method, in which ammonia is added to an aluminum salt solution to precipitate alumina, or by hydrolysis of an alkali aluminate. Anhydrous alumina can be obtained by dehydrating alumina hydrate by the action of heat.

The amount of filler to be added is preferably from 5 parts by mass to 2000 parts by mass relative to 100 parts by mass of the dry mass of the binder of the toner-image-receiving layer.

A crosslinking agent can be added in order to adjust the storage stability or thermoplastic properties of the toner image-receiving layer. Examples of the crosslinking agent include compounds containing two or more reactive groups in the molecule, such as an epoxy group, an isocyanate group, an aldehyde group, an active halogen group, an active methylene group, an acetylene group and other reactive groups known in the art.

The cross-linking agent may also be a compound having two or more groups capable of forming bonds such as hydrogen bonds, ionic bonds, coordinate bonds, or the like.

Examples of the cross-linking agent include a coupling agent for resin, curing agent, polymerizing agent, polymerization promoter, coagulant, film-forming agent, film-forming assistant, or the like. Examples of the coupling agents include chlorosilanes, vinylsilanes, epoxysilanes, aminosilanes, alkoxyaluminum chelates, titanate coupling agents, and the like. The examples further include other agents known in the art such as those mentioned in *Binran—Gomu purasuchikkusu no haigou yakuhin* [Handbook of Rubber and Plastics Additives] (ed. Rubber Digest Co.).

The charge control agent is added to adjust toner transfer, adhesion or the like to the toner-image-receiving layer, and prevent charge adhesion of the toner-image-receiving layer. The charge control agent may be any charge control agent known in the art. Examples of the charge control agent include surfactants such as a cationic surfactant, an anionic surfactant, an amphoteric surfactant, a nonionic surfactant, or the like; polymer electrolytes, conductive metal oxides, and the like. Examples include cationic charge inhibitors such as quaternary ammonium salts, polyamine derivatives, cation-modified polymethylmethacrylate, cation-modified polystyrene, or the like; anionic charge inhibitors such as alkyl phosphates, anionic polymers, or the like; and nonionic charge inhibitors such as aliphatic ester, polyethylene oxide, or the like. The examples are not limited thereto, however.

When the toner has a negative charge, it is preferred that the charge control agent blended with the toner image-receiving layer is, for example, cationic or nonionic.

Examples of the conductive metal oxides include ZnO, $TiO_2$, $SnO_2$, $Al_2O_3$, $In_2O_3$, $SiO_2$, MgO, BaO, $MoO_3$, and the like. These conductive metal oxides may be used alone, or may be used in the form of a complex oxide. Moreover, the conductive metal oxide may contain other elements. For example, ZnO may contain Al, In, or the like, $TiO_2$ may contain Nb, Ta, or the like, and $SnO_2$ may contain (or, dope) Sb, Nb, halogen elements, or the like.

The materials used to obtain the toner image-receiving layer may also contain various additives to improve image stability when output, or to improve stability of the toner image-receiving layer itself. Examples of the additives include various known antioxidants, age resistors, degradation inhibitors, anti-ozone degradation inhibitors, ultraviolet ray absorbers, metal complexes, light stabilizers, preservatives, fungicide, and the like.

Examples of the antioxidants include chroman compounds, coumarane compounds, phenol compounds (for example, hindered phenols), hydroquinone derivatives, hindered amine derivatives, spiroindan compounds, and the like. The antioxidants can be found, for example, in JP-A No. 61-159644.

Examples of age resistors include those found in *Binran—Gomu purasuchikku haigou yakuhin—kaitei dai* 2 *han* [Handbook of Rubber and Plastics Additives, Second Edition] (1993, Rubber Digest Co.), pp. 76-121.

Examples of the ultraviolet ray absorbers include benzotriazo compounds (described in the U.S. Pat. No. 3,533,794), 4-thiazolidone compounds (described in the U.S. Pat. No. 3,352,681), benzophenone compounds (described in JP-A No. 46-2784), ultraviolet ray absorbing polymers (described in JP-A No. 62-260152).

Examples of the metal complex include those described in U.S. Pat. Nos. 4,241,155, 4,245,018, 4254195, JP-A Nos. 61-88256, 62-174741, 63-199248, 01-75568, 01-74272, and the like.

Additives for photography known in the art may also be added to the material used to obtain the toner image-receiving layer as described above. Examples of the photographic additives can be found in the Journal of Research Disclosure (hereinafter referred to as RD) No. 17643 (December 1978), No. 18716 (November 1979) and No. 307105 (November 1989). The relevant sections are shown.

| Type of additive | RD17643 | RD18716 | RD307105 |
|---|---|---|---|
| 1. Whitener | p. 24 | p. 648 right column | p. 868 |
| 2. Stabilizer | pp. 24-25 | p. 649 right column | pp. 868-870 |
| 3. Light absorber (Ultraviolet ray absorber) | pp. 25-26 | p. 649 right column | pp. 873 |
| 4. Colorant image stabilizer | p. 25 | p. 650 right column | p. 872 |
| 5. Film hardener | p. 26 | p. 651 left column | p. 874-875 |
| 6. Binder | p. 26 | p. 651 left column | p. 873-874 |
| 7. Plasticizer, lubricant | p. 27 | p. 650 right column | p. 876 |
| 8. Auxiliary application agent (Surfactant) | pp. 26-27 | p. 650 right column | pp. 875-876 |
| 9. Antistatic agent | p. 27 | p. 650 right column | p. 876-877 |
| 10. Matting agent | | | pp. 878-879 |

—Physical Properties of Toner Image-Receiving Layer—

The thickness of the toner-image-receiving layer is, for example, preferably from 1 μm to 50 μm, and more preferably from 5 μm to 15 μm.

The 180° separation strength of the toner image-receiving layer at the fixing temperature by the fixing member is preferably 0.1 N/25 mm or less, and more preferably 0.041 N/25 mm or less. The 180° separation strength can be measured based on the method described in JIS K6887 using the surface material of the fixing member.

It is preferred that the toner image-receiving layer has a high degree of whiteness. This whiteness is measured by the method specified in JIS P 8123, and is preferably 85% or more. It is preferred that the spectral reflectance is 85% or more in the wavelength of 440 nm to 640 nm, and that the difference between the maximum spectral reflectance and minimum spectral reflectance in this wavelength is within 5%. Further, it is preferred that the spectral reflectance is 85% or more in the wavelength range of 400 nm to 700 nm, and that the difference between the maximum spectral reflectance and the minimum spectral reflectance in the wavelength is within 5%.

Specifically, for the whiteness, the value of L* is preferably 80 or higher, more preferably 85 or higher, and still more preferably 90 or higher in a CIE 1976 (L*a*b*) color space. The color tint of the white color is preferably as neutral as possible. Regarding the color tint of the whiteness, the value of $(a^*)^2+(b^*)^2$ is preferably 50 or less, more preferably 18 or less and still more preferably 5 or less in the (L*a*b*) space.

It is preferred that the toner image-receiving layer has a high surface gloss. The 45° gloss luster is preferably 60 or higher, more preferably 75 or higher, and still more preferably 90 or higher, over the whole range from white where there is no toner, to black where toner is densed at maximum.

However, the gloss luster is preferably 110 or less. If it is more than 110, the image has a metallic appearance which is undesirable.

Gloss luster may be measured by JIS Z 8741.

It is preferred that the toner image-receiving layer has a high smoothness. The arithmetic average roughness (Ra) is preferably 3 μm or less, more preferably 1 μm or less, and still more preferably 0.5 μm or less, over the whole range from white where there is no toner, to black where toner is densed at maximum.

Arithmetic average roughness may be measured by JIS B 0601, B 0651, and B 0652.

It is preferred that the toner image-receiving layer has one of the following physical properties, more preferred that it has several of the following physical properties, and most preferred that it has all of the following physical properties.

(1) $T_m$ (Melting temperature) of the toner image-receiving layer is preferably 30° C. or more, and more preferably equal to or less than $T_m$+20° C. of the toner.

(2) The temperature at which the viscosity of the toner image-receiving layer is $1\times10^5$ cp is preferably 40° C. or higher, and more preferably lower than the corresponding temperature for the toner.

(3) At a fixing temperature of the toner image-receiving layer, the storage elasticity modulus (G') is preferably $1\times10^3$ Pa to $1\times10^5$ Pa. The loss elasticity modulus (G") is preferably from $1\times10^2$ Pa to $1\times10^5$ Pa.

(4) The loss tangent (G"/G'), which is the ratio of the loss elasticity modulus (G") to the storage elasticity modulus (G') at a fixing temperature of the toner-image-receiving layer, is preferably from 0.01 to 10.

(5) The storage modulus (G') at a fixing temperature of the toner image-receiving layer is preferably from −50 to +2500, relative to the loss elasticity modulus (G") at a fixing temperature of the toner.

(6) The inclination angle on the toner-image-receiving layer of the molten toner is preferably 50° or less, and more preferably 40° or less.

The toner image-receiving layer preferably satisfies the physical properties described in Japanese Patent No. 2788358, and JP-A Nos. 07-248637, 08-305067 and 10-239889.

It is preferred that the surface electrical resistance of the toner image-receiving layer is $1\times10^6$ Ω/cm$^2$ to $1\times10^{15}$ Ω/cm$^2$ (under conditions of 25° C., 65% RH).

If the surface electrical resistance is less than $1\times10^6$ Ω/cm$^2$, the toner amount transferred to the toner image-receiving layer is insufficient, and the density of the toner image obtained may be too low. On the other hand, if the surface electrical resistance is more than $1\times10^{15}$ Ω/cm$^2$, more charge than necessary is produced during transfer. Therefore, toner is transferred insufficiently, image density is low and static electricity develops causing dust to adhere during handling of the electrophotographic image-receiving paper, or misfeed, overfeed, discharge marks or toner transfer dropout may occur.

The surface electrical resistance of the surface on the opposite surface of the support to the toner image-receiving layer is preferably $5\times10^8$ Ω/cm$^2$ to $3.2\times10^{10}$ Ω/cm$^2$, and more preferably $1\times10^9$ Ω/cm$^2$ to $1\times10^{10}$ Ω/cm$^2$.

The surface electrical resistances are measured based on JIS K 6911. The sample is left with air-conditioning for 8 hours or more at a temperature of 20° C. and the humidity of 65%. Measurements are made using an R8340 produced by Advantest Ltd., under the same environmental conditions after giving an electric current for 1 minute at an applied voltage of 100V.

Other layers of the electrophotographic image-receiving material may include, for example, a surface protective layer, backing layer, contact improving layer, intermediate layer, undercoat, cushion layer, charge control (inhibiting) layer, reflecting layer, tint adjusting layer, storage ability improving layer, anti-adhering layer, anti-curl layer, smoothing layer, and the like. These layers may have a single-layer structure or may be formed of two or more layers.

<Silver Halide Photographic Photosensitive Material>

The silver halide photographic photosensitive material has, for example, a configuration in which an image-recording layer which develops at least yellow, magenta, and cyan is disposed on a support for image-recording according to the present invention. It is generally used in, for example, silver halide photography in which an exposed and printed silver halide photographic sheet is soaked in several treatment baths one after another so as to perform color developing, bleaching and fixing, washing with water, and drying.

The support for image-recording preferably employs a press-dry treated raw paper sheet according to the present invention, and more preferably a support including polyethylene resin layers disposed on both sides of the raw paper sheet.

<Inkjet-Recording Material>

The inkjet recording material includes, for example, a colorant receiving layer disposed on a support for image recording according to the present invention, where the colorant receiving layer is capable of receiving a liquid ink such as an aqueous ink (using a pigment or dye as the colorant), an oil ink, and the like; a solid ink which is solid at room temperature and which is melted and liquefied when used for a print; and the like.

The support for image-recording preferably employs a press-dry treated raw paper sheet according to the present invention, and more preferably a support including polyethylene resin layers disposed on both sides of the raw paper sheet.

<Thermal Transfer Image-Receiving Material>

The thermal transfer material has, for example, a configuration in which at least a heat-coloring layer is disposed on a support for image recording according to the present invention. Examples thereof include, but are not limited to, thermal color development recording material used in thermo-autochrome method in which a repetition of heating by a heating head and fixing by ultraviolet light forms an image.

The support for image-recording preferably employs a press-dry treated raw paper sheet according to the present invention, and more preferably a support including polyethylene resin layers disposed on both sides of the raw paper sheet.

<Thermal Color Development Recording Material>

The thermal color development recording material has, for example, a configuration in which at least a heat-melting ink layer as an image-recording layer is disposed on a support for image recording according to the present invention. It is generally used in, for example, a method in which a heating head heats a heat-melting ink layer so as to melt and transfer the ink to an image-receiving sheet for thermal transfer recording.

The support for image-recording preferably employs a press-dry treated raw paper sheet according to the present invention having a density of 0.9 g/cm$^3$ or more, and more preferably a support including polyethylene resin layers disposed on both sides of the raw paper sheet.

<Sublimation Transfer Image-Receiving Material>

The sublimation transfer image-receiving material has, for example, a configuration in which at least an ink layer containing a heat-dispersive pigment (subliming pigment) is disposed on a support for image recording according to the present invention. It is generally used in, for example, a sublimation transfer method in which a heating head heats an ink layer so as to transfer the heat-dispersive pigment to an image-receiving sheet for thermal transfer recording.

The support for image-recording preferably employs a press-dry treated raw paper sheet according to the present invention, and more preferably a support including polyethylene resin layers disposed on both sides of the raw paper sheet.

Hereafter, the present invention will be described by means of examples, but it will be understood that the invention should not be construed as being limited thereby.

EXAMPLE 1

Broad-leaved (hardwood) bleached kraft pulp (LBKP) was beaten to a Canadian standard freeness (CSF) of 300 ml using a disk refiner and thereby yielded a pulp stock having a mass average fiber length of 0.58 mm. Various additives were added to the pulp paper material in the following proportions.

| Additive type | Relative amount to pulp mass (%) |
|---|---|
| Cation starch | 1.2 |
| Alkyl ketene dimer (AKD) | 0.5 |
| Anion polyacrylamide | 0.2 |
| Epoxidized fatty acid amide (EFA) | 0.2 |
| Polyamide polyamine epichlorhydrin | 0.3 |

Note:
In the alkyl ketene dimer (AKD), the alkyl moiety is derived from fatty acids mainly containing behenic acid. In the epoxidized fatty acid amide (EFA), the fatty acid moiety is derived from fatty acids mainly containing behenic acid.

After adding these additives, the pulp paper material was treated with a papermaking machine to make wet paper having an absolute dry weight of 160 g/m$^2$ and water content of 68%.

Both sides of the wet paper were covered with filter paper and dehydrated using a wet press apparatus to adjust water content to 50%.

The dehydrated wet paper was then dried with a press dry apparatus similar to the one shown in FIG. 1 (Static Condebelt available from VALMET) to yield raw paper with water content of 7.1%.

The press dry treatment was performed in a condition where the temperature of an upper plate which was in contact with the raw paper on the side where an image-recording layer was to be formed (front side) was set at 160° C., the temperature of a lower plate which wass in contact with the raw paper on the side where no image-recording layer was to be formed (back side) at 85° C., pressure at 0.45 MPa, and drying time at 1 second.

The press-dry-treated raw paper was then calendered using a machine calender apparatus under the following conditions. The paper was passed through so that a metal roller having a surface temperature of 110° C. was in contact with the side of the raw paper on which an image-recording layer was to be formed (front side). In this specification, including the claims, the terms "calender," "calender apparatus," and "calendering apparatus," when referring to a machine used for calendering, mean the same.

—Machine Calender Apparatus—

The machine calender apparatus was arranged so that the front side of the raw paper (the side on which an image-recording layer was to be formed) was in contact with a metal roller (surface temperature 110° C.) and that the back side of the raw paper (the side on which no image-recording layer was to be formed) was in contact with another metal roller (surface temperature 90° C.). Nip pressure was 180 kN/m$^2$.

After calendaring, the raw paper was calendered using a soft calender under the following conditions. The raw paper was passed through so that a metal roller having a surface temperature of 210° C. was in contact with the image-recording side. Calendering was adjusted so that the density of the raw paper was 1.03 g/cm$^3$. The surface temperature of a resin roller which was in contact with the side where no image-recording layer was to be formed was set at 40° C.

—Soft Calender Apparatus—

The soft calender apparatus was arranged so that the front side of the raw paper (the side on which an image-recording layer was to be formed) was in contact with a metal roller (surface temperature 210° C.) and that the back side of the raw paper was in contact with a urethane resin roller (surface temperature 40° C.). Nip pressure was 200 kN/m$^2$.

EXAMPLES 2-5 AND COMPARATIVE EXAMPLES 1-6

Various conditions for the papermaking process were set as shown in Tables 1 to 3, and in the same manner as in Example 1, supports for an image-recording material of Examples 2 to 5 and Comparative Examples 1 to 6 were prepared.

TABLE 1

Properties of pulp paper material and raw paper

| | Freeness (C.F.S.) | Fiber length (mm) | Water content (before/after drying) | Density (g/cm$^3$) |
|---|---|---|---|---|
| Example 1 | 300 ml | 0.58 | 50%/7.1% | 1.03 |
| Example 2 | 300 ml | 0.58 | 46%/7.1% | 1.02 |
| Example 3 | 300 ml | 0.58 | 43%/6.9% | 1.02 |
| Example 4 | 280 ml | 0.54 | 53%/6.8% | 1.01 |

TABLE 1-continued

Properties of pulp paper material and raw paper

| | Freeness (C.F.S.) | Fiber length (mm) | Water content (before/after drying) | Density (g/cm$^3$) |
|---|---|---|---|---|
| Example 5 | 390 ml | 0.62 | 55%/6.5% | 0.99 |
| Comparative Example 1 | 390 ml | 0.65 | 28%/6.5% | 1.00 |
| Comparative Example 2 | 300 ml | 0.58 | 78%/6.8% | 1.01 |
| Comparative Example 3 | 300 ml | 0.58 | 25%/6.5% | 0.99 |
| Comparative Example 4 | 300 ml | 0.58 | 55%/6.8% | 0.86 |
| Comparative Example 5 | 320 ml | 0.61 | 55%/6.5% | 0.98 |
| Comparative Example 6 | 480 ml | 0.72 | 53%/6.7% | 1.02 |

TABLE 2

Settings and conditions of papermaking process

| | Drying method | Drying temperature (front/backside) | Pressure (MPa) |
|---|---|---|---|
| Example 1 | Press drying | 160° C./85° C. | 0.51 |
| Example 2 | Press drying | 140° C./85° C. | 0.32 |
| Example 3 | Press drying | 120° C./80° C. | 0.12 |
| Example 4 | Press drying | 170° C./80° C. | 0.70 |
| Example 5 | Press drying | 140° C./80° C. | 0.31 |
| Comparative Example 1 | Press drying | 140° C./85° C. | 0.29 |
| Comparative Example 2 | Press drying | 210° C./85° C. | 1.31 |
| Comparative Example 3 | Press drying | 90° C./80° C. | 0.04 |
| Comparative Example 4 | Press drying | 140° C./85° C. | 0.35 |
| Comparative Example 5 | Cylinder drying | 80° C.-130° C. | None |
| Comparative Example 6 | Cylinder drying | 80° C.-130° C. | None |

TABLE 3

Settings and conditions of calendering

| | Machine calendering Temperature (front/backside) | Soft calendering Temperature (front/backside) | Shoe calendering Temperature (front/backside) |
|---|---|---|---|
| Example 1 | 110° C./90° C. | 210° C./45° C. | None |
| Example 2 | 110° C./90° C. | None | None |
| Example 3 | None | 50° C./210° C. (1st calendaring)<br>210° C./50° C. (2nd calendaring) | None |
| Example 4 | 110° C./90° C. | None | None |
| Example 5 | 110° C./90° C. | None | 210° C./45° C. |
| Comparative Example 1 | 110° C./90° C. | 210° C./45° C. | None |
| Comparative Example 2 | 110° C./90° C. | 210° C./45° C. | None |
| Comparative Example 3 | 110° C./90° C. | None | None |
| Comparative Example 4 | None | None | None |
| Comparative Example 5 | 110° C./90° C. | None | None |

TABLE 3-continued

| | Settings and conditions of calendering | | |
|---|---|---|---|
| | Machine calendering Temperature (front/backside) | Soft calendering Temperature (front/backside) | Shoe calendering Temperature (front/backside) |
| Comparative Example 6 | 110° C./90° C. | None | None |

EXAMPLES 6-10 AND COMPARATIVE EXAMPLES 7-12

—Preparation of Electrophotographic Image-Receiving Paper—

Using the obtained raw papers, electrophotographic image-receiving papers of Examples 6 to 10 and Comparative Examples 7 to 12 were prepared in the following manner.

—Preparation of Titanium Dioxide Dispersion—

The following components were blended and dispersed using a NBK-2 non-bubbling kneader available from Nippon Seiki to prepare a titanium dioxide dispersion (titanium dioxide pigment: 40% by mass).

| | |
|---|---|
| Titanium dioxide (TIPAQUE (registered Trademark) A-220, available from Ishihara Sangyo Kaisha, Ltd.) | 40.0 g |
| Polyvinyl alcohol (PVA102, available from Kuraray Co., Ltd.) | 2.0 g |
| Ion exchange water | 58.0 g |

—Preparation of Coating Solution for Toner-image-receiving Layer—

The following components were mixed and stirred to prepare the coating solution for toner-image-receiving layer.

| | |
|---|---|
| Aforementioned titanium dioxide dispersion solution | 15.5 g |
| Carnauba wax dispersion (Cellosol 524, available from Chukyo Yushi Co., Ltd.) | 15.0 g |
| Polyester resin aqueous dispersion (solids 30%, KZA-7049, Unitika Ltd.) | 100.0 g |
| Thickener (Alcox E30, MEISEI CHEMICAL WORKS, LTD) | 2.0 g |
| Anionic surfactant (AOT) | 0.5 g |
| Ion exchange water | 80 ml |

The obtained coating solution for toner-image-receiving layer had a viscosity of 40 m·Pa·s and a surface tension of 34 mN/m.

—Preparation of Backing Layer Coating Solution—

The following components were mixed and stirred to prepare a backing layer coating solution.

| | |
|---|---|
| Acrylate resin aqueous dispersion (solids 30%, High-Loss XBH-997L, available from Seiko Chemicals) | 100.0 g |
| Matting agent (Techpolymer MBX-12, available from Sekisui Plastics Co., Ltd.) | 5.0 g |
| Releasing agent (Hydrin D337, Chukyo Yushi Co., Ltd.) | 10.0 g |
| Thickener (CMC) | 2.0 g |
| Anionic surfactant (AOT) | 0.5 g |
| Ion exchange water | 80 ml |

The backing layer coating solution had a viscosity of 35 mPa s and a surface tension of 33 mN/m.

—Coating of Backing Layer and Toner Image-receiving Layer—

For each raw paper of Examples 1 to 5 and Comparative Examples 1 to 6, the backing layer coating solution was applied with a bar coater on the back side of the side which is in contact with a heating roller. Then, on the side which is in contact with the heating roller, the coating solution for toner-image-receiving layer was applied with a bar coater in the same manner as the backing layer.

The toner-image-receiving layer coating solution and the backing layer coating solution were each coated so that, for the backing layer, the coating amount is 9 g/m$^2$ in dry mass, and for the toner-image-receiving layer, the coating amount was 12 g/m$^2$ in dry mass. The content of the pigment in the toner-image-receiving layer was 5% by mass, relative to the mass of the thermoplastic resin.

After the backing layer coating solution and the toner-image-receiving layer coating solution were coated, they were dried by hot air, online. Airflow and temperature for drying were adjusted, so that both the backside and the toner-image-receiving side were dried within 2 minutes after coating. The point of dryness was determined when the surface temperature of the coating was equal to the wet-bulb temperature of the airflow for drying.

After drying, a calender treatment was performed. A gloss calender was used for the calender treatment in which the temperature of a metal roller was maintained at 40° C. and nip pressure was set at 14.7 kN/m$^2$.

<Performance Evaluation>

Each of the obtained electrophotographic image-receiving paper was cut to A4 size, and an image was printed thereon. The printer used here was a color laser printer (DocuColor 1250-PF) produced by Fuji Xerox Co., Ltd., except that an apparatus having the fixing belt shown in FIG. 3 was installed.

Figure 3:
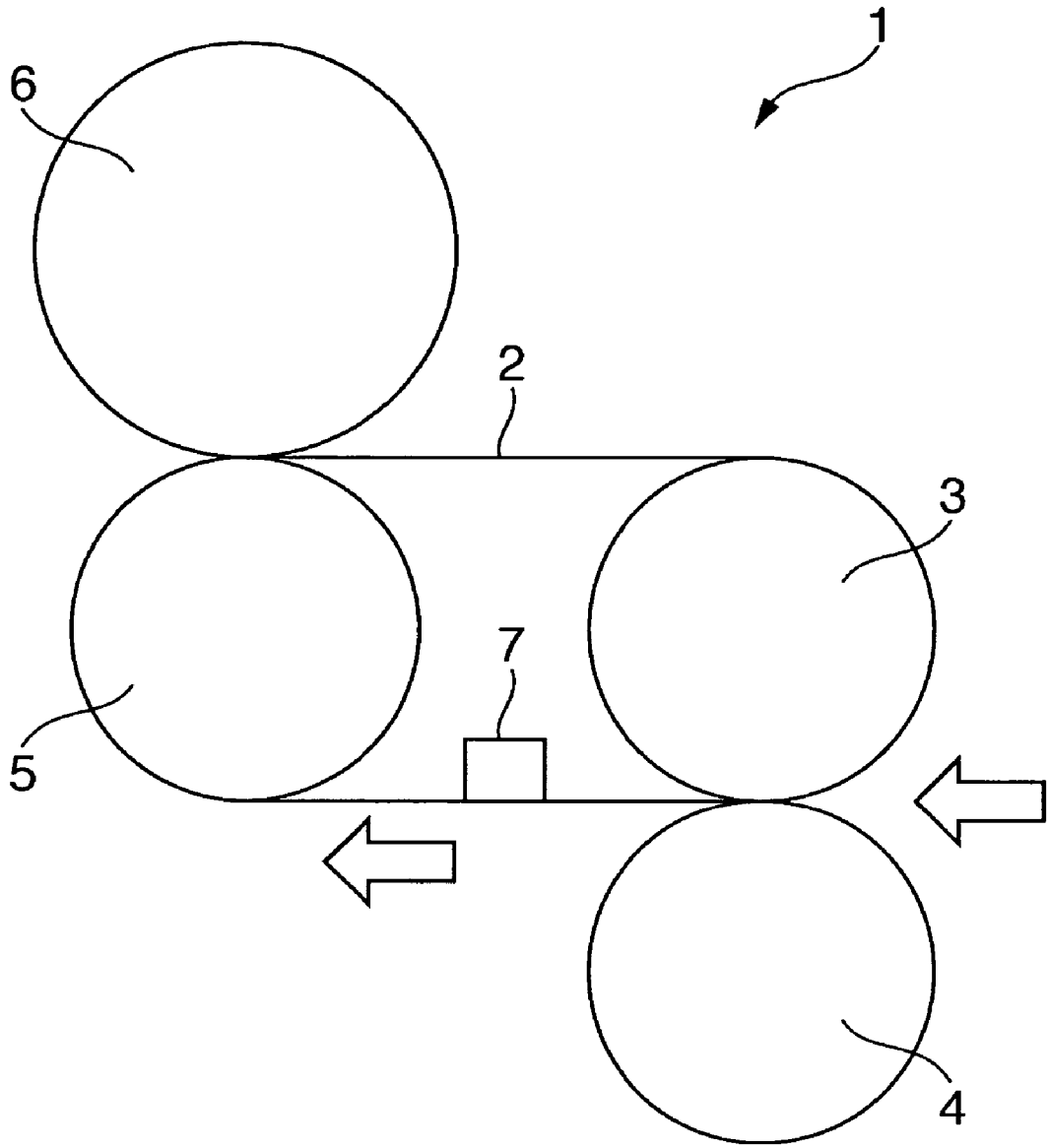
FIG. 3 is a schematic view of a configuration of the fixing belt apparatus of the printer which is used in the Examples.

Specifically, in the apparatus having a fixing belt 1 as shown in FIG. 3, a fixing belt 2 is suspended around a heating roller 3 and a tension roller 5. A cleaning roller 6 is provided via the fixing belt 2 above the tension roller 5, and a pressurizing roller 4 is further provided via the fixing belt 2 below the heating roller 3. In FIG. 3, starting from the right-hand side, the electrophotographic image-receiving sheet carrying a toner latent image was introduced between the heating roller 3 and the pressurizing roller 4, was fixed and transported on the fixing belt 2. Thereafter, in this process, the toner latent image was cooled by a cooling device 7, and the fixing belt 2 was finally cleaned by a cleaning roller 6.

In the apparatus having a fixing belt, the transport speed at the fixing belt 2 is 30 mm/sec, the nip pressure between the heating roller 3 and the pressurizing roller 4 was 0.2 MPa (2 kgf/cm$^2$), and the temperature of the heating roller 3 was 150° C. which corresponded to the fixing temperature. The temperature of the pressurizing roller 4 was set at 120° C.

For each electrophotographic print obtained, image quality and gloss were evaluated in the following manner. The results are shown in Table 4.

—Evaluation of Image Quality—

The image quality of each electrophotographic print was visually observed and was evaluated. The print with the best image quality was assigned A, followed by B, C, D and E on the following basis.

[Evaluation Standards]

A Very good (Sufficient for high-image-quality recording material)

B Good (Sufficient for high-image-quality recording material)

C Mediocre (Insufficient for high-image-quality recording material)

D Poor (Insufficient for high-image-quality recording material)

E Very poor (Insufficient for high-image-quality recording material)

—Evaluation of Gloss—

The gloss of each electrophotographic print was visually observed and was evaluated. The print with the best gloss was assigned A, followed by B, C, D and E on the following basis.

[Evaluation Standards]

A Very good (Sufficient for high-image-quality recording material)

B Good (Sufficient for high-image-quality recording material)

C Mediocre (Insufficient for high-image-quality recording material)

D Poor (Insufficient for high-image-quality recording material)

E Very poor (Insufficient for high-image-quality recording material)

TABLE 4

| | Support | Gloss | Image quality |
|---|---|---|---|
| Example 6 | Example 1 | A | A |
| Example 7 | Example 2 | A | A |
| Example 8 | Example 3 | B | A |
| Example 9 | Example 4 | A | A |
| Example 10 | Example 5 | A | A |
| Comparative Example 7 | Comparative Example 1 | D | C |
| Comparative Example 8 | Comparative Example 2 | B | E |
| Comparative Example 9 | Comparative Example 3 | D | C |
| Comparative Example 10 | Comparative Example 4 | C | E |
| Comparative Example 11 | Comparative Example 5 | C | C |
| Comparative Example 12 | Comparative Example 6 | C | D |

Results in Tables 1 to 4 show that electrophotographic image-receiving papers of Examples 6 to 10, which employ raw paper made by press dry treatment of pulp paper material having a freeness of from 200 ml C.S.F. to 400 ml C.S.F. at a drying temperature of from 100° C. to 200° C., have better gloss and image quality compared with electrophotographic image-receiving papers of Comparative Examples 7 to 12.

EXAMPLES 11-15 AND COMPARATIVE EXAMPLES 13-18

—Preparation of Photographic Printing Paper—

For each raw paper of Examples 1 to 5 and Comparative Examples 1 to 6, LDPE containing 10% by mass of $TiO_2$ was extrusion coated at a thickness of 25 μm on the side which is in contact with a heating roller. On the side which is not in contact with the heating roller, polyethylene (PE) mixture of LDPE and HDPE having a mixture ratio of 1 to 1 by mass was extrusion coated at a thickness of 20 μm. Corona discharge treatment was performed on the LDPE side and 0.1 g/m$^2$ of gelatin was applied so as to form a support for photographic printing paper.

On the gelatin-applied side of each support for photographic printing paper, typical silver halide photographic emulsion was applied and thus photographic printing papers of Examples 11 to 15 and Comparative Examples 13 to 18 were made. The photographic printing papers were exposed and developed to yield photographic prints.

<Performance Evaluation>

For each photographic print, surface smoothness (small-scale irregularity (1 mm or less) and large-scale irregularity (5-6 mm)) was evaluated in the following manner. The results are shown in Table 5.

—Surface Smoothness (Small-Scale Irregularity (1 mm or Less))—

The surface appearance of each photographic print was visually observed and was evaluated. The print with the best surface smoothness (small-scale irregularity (1 mm or less)) was assigned A, followed by B, C, D and E on the following basis.

[Evaluation Standards]

A Very good (Sufficient for high-image-quality recording material)

B Good (Sufficient for high-image-quality recording material)

C Mediocre (Insufficient for high-image-quality recording material)

D Poor (Insufficient for high-image-quality recording material)

E Very poor (Insufficient for high-image-quality recording material)

—Surface Smoothness (Large-Scale Irregularity (5-6 mm))—

The surface appearance of each photographic print was visually observed and was evaluated. The print with the best surface smoothness (large-scale irregularity (5-6 mm)) was assigned A, followed by B, C, D and E on the following basis.

[Evaluation Standards]

A Very good (Sufficient for high-image-quality recording material)

B Good (Sufficient for high-image-quality recording material)

C Mediocre (Insufficient for high-image-quality recording material)

D Poor (Insufficient for high-image-quality recording material)

E Very poor (Insufficient for high-image-quality recording material)

TABLE 5

| | Support | Surface smoothness | |
|---|---|---|---|
| | | Small-scale irregularity | Large-scale irregularity |
| Example 11 | Example 1 | A | A |
| Example 12 | Example 2 | B | A |
| Example 13 | Example 3 | B | B |
| Example 14 | Example 4 | A | A |
| Example 15 | Example 5 | A | B |
| Comparative Example 13 | Comparative Example 1 | C | C |
| Comparative Example 14 | Comparative Example 2 | D | E |
| Comparative Example 15 | Comparative Example 3 | D | C |
| Comparative Example 16 | Comparative Example 4 | D | E |
| Comparative Example 17 | Comparative Example 5 | C | D |
| Comparative Example 18 | Comparative Example 6 | C | E |

Results in Tables 1 to 3 and 5 show that the photographic printing papers of Examples 11 to 15, which employ raw paper made by press dry treatment of pulp paper material having a freeness of from 200 ml C.S.F. to 400 ml C.S.F. at a drying temperature of from 100° C. to 200° C., have better gloss and image quality compared with the photographic printing papers of Comparative Examples 13 to 18.

According to the present invention, it is possible to provide supports for an image-recording material which have better density, elasticity modulus, tensile strength, strength, and the like; which are excellent in dimension stability and smoothness; and with which curling is less likely to occur. Also, it is possible to provide image-recording materials using such supports thereby being capable of forming high quality images.

What is claimed is:

1. A process for manufacturing a support for image-recording material, comprising:

pressure drying a wet paper at a temperature of from 110° C. to 180° C. while applying pressure of 0.05 MPa to 1.5 MPa to a side of the wet paper on which an image-recording layer is to be formed, wherein the wet paper has a water content of 30% to 70% prior to pressure drying.

2. A process for manufacturing a support for image-recording material according to claim 1, wherein pressure drying is performed with a pressing machine.

3. A process for manufacturing a support for image-recording material according to claim 1, further comprising:

calendering an article made by pressure drying the wet paper with at least one calendering apparatus.

4. A process for manufacturing a support for image-recording material according to claim 3, wherein calendering is performed using at least one of a machine calendering apparatus, a soft calendering apparatus, and a shoe calendering apparatus.

5. A process for manufacturing a support for image-recording material according to claim 3, wherein the calendering apparatus has a metal roller with a surface temperature of 110° C. or higher.

6. A process for manufacturing a support for image-recording material according to claim 1, wherein the wet paper after pressure drying comprises a pulp paper material having a freeness of from 200 ml C.S.F. to 400 ml C.S.F.

7. A process for manufacturing a support for image-recording material according to claim 1, wherein the wet paper after pressure drying comprises a pulp paper material having a mass average fiber length of from 0.45 mm to 0.70 mm.

8. A process for manufacturing a support for image-recording material according to claim 1, wherein the wet paper after pressure drying comprises at least one of alkyl ketene dimer and an epoxy aliphatic amide.

9. A process for manufacturing a support for image-recording material according to claim 1, wherein a polymer layer is coated on at least one side of the wet paper after pressure drying.

10. A process for manufacturing a support for image-recording material according to claim 9, wherein the polymer layer comprises a polyolefin resin.

* * * * *